US009108416B2

(12) United States Patent
Norikane et al.

(10) Patent No.: US 9,108,416 B2
(45) Date of Patent: Aug. 18, 2015

(54) PRINTING FLUID CARTRIDGE HAVING CARTRIDGE BODY AND BRACKET

(71) Applicants: Shunsuke Norikane, Nagoya (JP); Yuki Takagi, Nagoya (JP)

(72) Inventors: Shunsuke Norikane, Nagoya (JP); Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 42 days.

(21) Appl. No.: 13/725,564

(22) Filed: Dec. 21, 2012

(65) Prior Publication Data

US 2013/0162734 A1 Jun. 27, 2013

(30) Foreign Application Priority Data

Dec. 22, 2011 (JP) ..... 2011-282153

(51) Int. Cl.
*B41J 2/175* (2006.01)

(52) U.S. Cl.
CPC ..... *B41J 2/1752* (2013.01); *B41J 2/1754* (2013.01); *B41J 2/17503* (2013.01); *B41J 2/17509* (2013.01); *B41J 2/17513* (2013.01); *B41J 2/17526* (2013.01); *B41J 2/17533* (2013.01); *B41J 2/17536* (2013.01); *B41J 2/17553* (2013.01)

(58) Field of Classification Search
CPC ..... B41J 2/17503
See application file for complete search history.

(56) References Cited

U.S. PATENT DOCUMENTS

| | | | |
|---|---|---|---|
| 6,164,769 | A | 12/2000 | Inada et al. |
| 6,416,152 | B1 | 7/2002 | Matsuzaki et al. |
| 2001/0017640 | A1 | 8/2001 | Inada et al. |
| 2009/0058964 | A1 | 3/2009 | Hattori et al. |

FOREIGN PATENT DOCUMENTS

| | | | |
|---|---|---|---|
| JP | H07-323565 | A | 12/1995 |
| JP | 2000-037880 | A | 2/2000 |
| JP | 2009-056739 | A | 3/2009 |
| JP | 2009-132098 | A | 6/2009 |

*Primary Examiner* — Justin Seo
(74) *Attorney, Agent, or Firm* — Baker Botts L.L.P.

(57) ABSTRACT

In a printing fluid cartridge, a cartridge body has a printing fluid delivery unit provided on a first cartridge-body surface. A bracket has at least a first bracket wall confronting the first cartridge-body surface, and a second bracket wall extending continuously from the first bracket wall in a first direction. The bracket is capable of moving relative to the cartridge body in a direction along which the second bracket wall contacts and separates from the cartridge body. A restriction member is configured to be detachably mounted on the cartridge body and the bracket, and is configured to, when the restriction member is mounted on the cartridge body and the bracket, restrict relative movement between the cartridge body and the bracket, with the second bracket wall of the bracket in contact with the cartridge body.

8 Claims, 17 Drawing Sheets

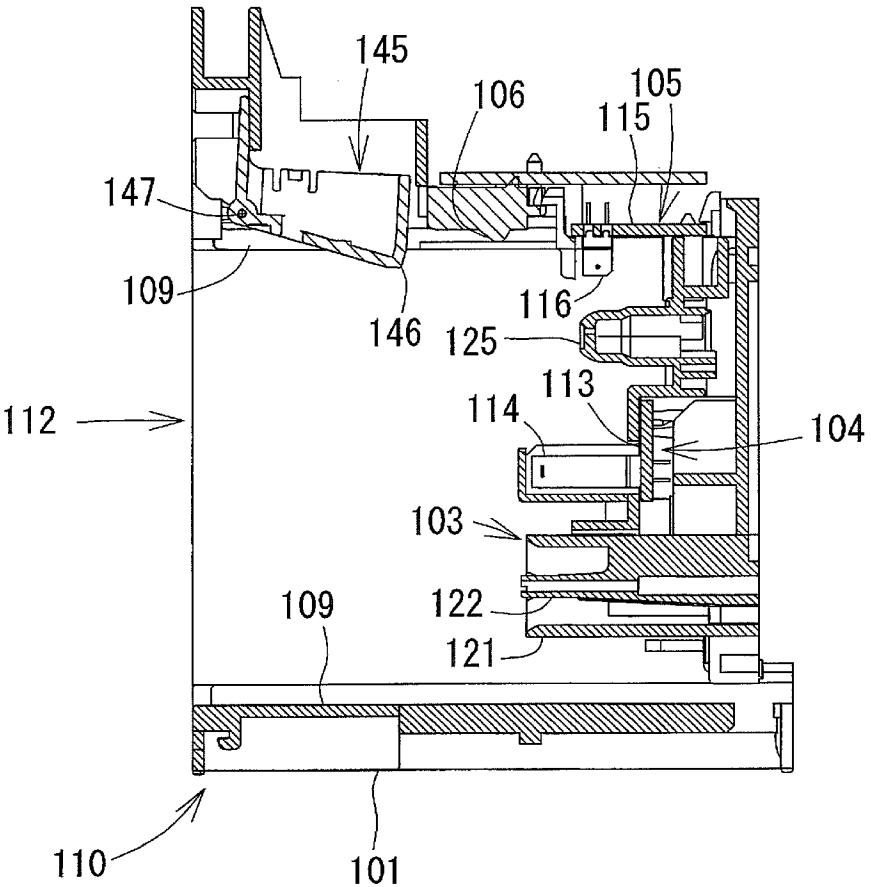
FIG.6
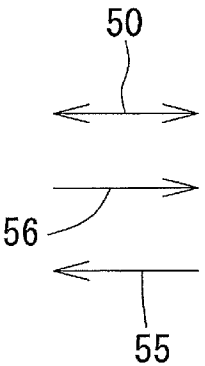

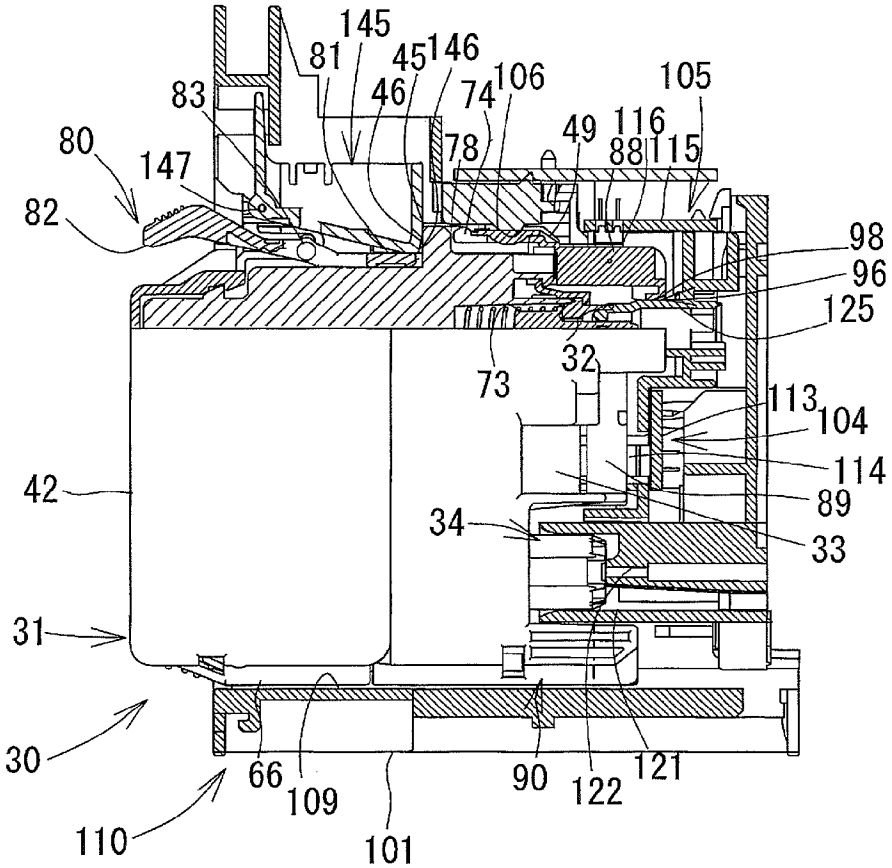
FIG.9
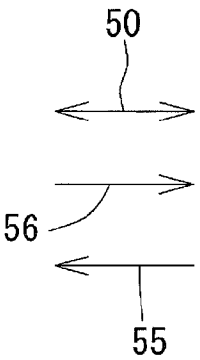

PRINTING FLUID CARTRIDGE HAVING CARTRIDGE BODY AND BRACKET

CROSS REFERENCE TO RELATED APPLICATION

This application claims priority from Japanese Patent Application No. 2011-282153 filed Dec. 22, 2011. The entire content of this priority application is incorporated herein by reference.

TECHNICAL FIELD

The present invention relates to a printing fluid cartridge.

BACKGROUND

There is conventionally known an image recording apparatus recording an image on a recording sheet by using ink. The image recording apparatus is provided with a recording head of an ink ejection type, which selectively ejects ink droplets from nozzles in a direction toward the recording sheet. The ink droplets are deposited on the recording sheet, thereby forming a desired image on the recording sheet. An ink cartridge is mounted in the image recording apparatus. The ink cartridge stores ink to be supplied to the recording head. The ink cartridge is mountable in a cartridge mounting unit provided in the image recording apparatus.

Some ink cartridges are provided with an electronic component, such as a memory module, in order to indicate information of the individual ink cartridges, such as color and material of ink, the amount of remaining ink, and a maintenance state of the ink cartridge. When the ink cartridge is mounted in the cartridge mounting unit, the memory module is electrically conducted with contacts provided in the cartridge mounting unit, as a result of which data becomes readable from the memory module.

SUMMARY

During the process of mounting the ink cartridge into the cartridge mounting unit, an ink supply tube is inserted into an ink supply unit in the ink cartridge. So, the ink cartridge has to be positioned relative to the cartridge mounting unit such that the ink supply unit is aligned with the ink supply tube. The ink cartridge has to be positioned relative to the cartridge mounting unit also such that the memory module is aligned with the contacts and can contact the contacts. High accuracy of dimension is required when laying out the ink supply unit and an access unit in the ink cartridge so that the ink supply unit and the memory module can be accurately positioned relative to the corresponding parts, such as the ink supply tube and the contacts, in the cartridge mounting unit.

It is conceivable to configure the ink cartridge such that the ink cartridge includes a main body and a bracket having an access unit such as a memory module, and such that the bracket is movable relative to the main body.

In such a configuration, a gap is formed between the main body and the bracket. So, while the ink cartridge is in storage or in transit, a force is applied to the bracket in a direction to compress the gap. The bracket will possibly be deformed. If the bracket is deformed, the bracket will not move smoothly relative to the main body, or a positional accuracy in the access unit will be reduced.

In view of the foregoing, it is an object of the present invention to provide a printing fluid cartridge that has a main body and a bracket movable relative to the main body and whose bracket is restricted from being deformed.

In order to attain the above and other objects, the present invention provides a printing fluid cartridge, including: a cartridge body; a bracket; and a restriction member. The cartridge body has a printing fluid delivery unit provided on a first cartridge-body surface. The bracket has at least a first bracket wall that confronts the first cartridge-body surface of the cartridge body, and a second bracket wall extending continuously from the first bracket wall in a first direction, the bracket being capable of moving relative to the cartridge body in a direction along which the second bracket wall contacts and separates from the cartridge body. The restriction member is configured to be detachably mounted on the cartridge body and the bracket, the restriction member being configured to, when the restriction member is mounted on the cartridge body and the bracket, restrict relative movement between the cartridge body and the bracket, with the second bracket wall of the bracket in contact with the cartridge body.

According to another aspect, the invention provides a restriction member capable of being mounted in a printing fluid cartridge, the printing fluid cartridge including: a cartridge body having a printing fluid delivery unit provided on a first cartridge-body surface; and a bracket having at least a first bracket wall that confronts the first cartridge-body surface of the cartridge body, and a second bracket wall extending continuously from the first bracket wall in a first direction, the bracket being capable of moving relative to the cartridge body in a direction along which the second bracket wall contacts and separates from the cartridge body. The restriction member is configured to be detachably mounted on the cartridge body and the bracket, the restriction member being configured to, when the restriction member is mounted on the cartridge body and the bracket, restrict relative movement between the cartridge body and the bracket, with the second bracket wall of the bracket in contact with the cartridge body.

BRIEF DESCRIPTION OF THE DRAWINGS

The particular features and advantages of the invention as well as other objects will become apparent from the following description taken in connection with the accompanying drawings, in which:

FIG. 6 is a cross-sectional view showing the configuration of the cartridge mounting unit;

FIGS. 7-9 are partial cross-sectional views of the ink cartridge and the cartridge mounting unit, showing the process of mounting the ink cartridge in the cartridge mounting unit, wherein FIG. 7 shows the state that the ink cartridge is inserted into the cartridge mounting unit, FIG. 8 shows the state that the ink cartridge is further moved into the cartridge mounting unit after the state of FIG. 7, and FIG. 9 shows the state that the ink cartridge is completely mounted in the cartridge mounting unit after the state of FIG. 8;

DETAILED DESCRIPTION

Figure 1:
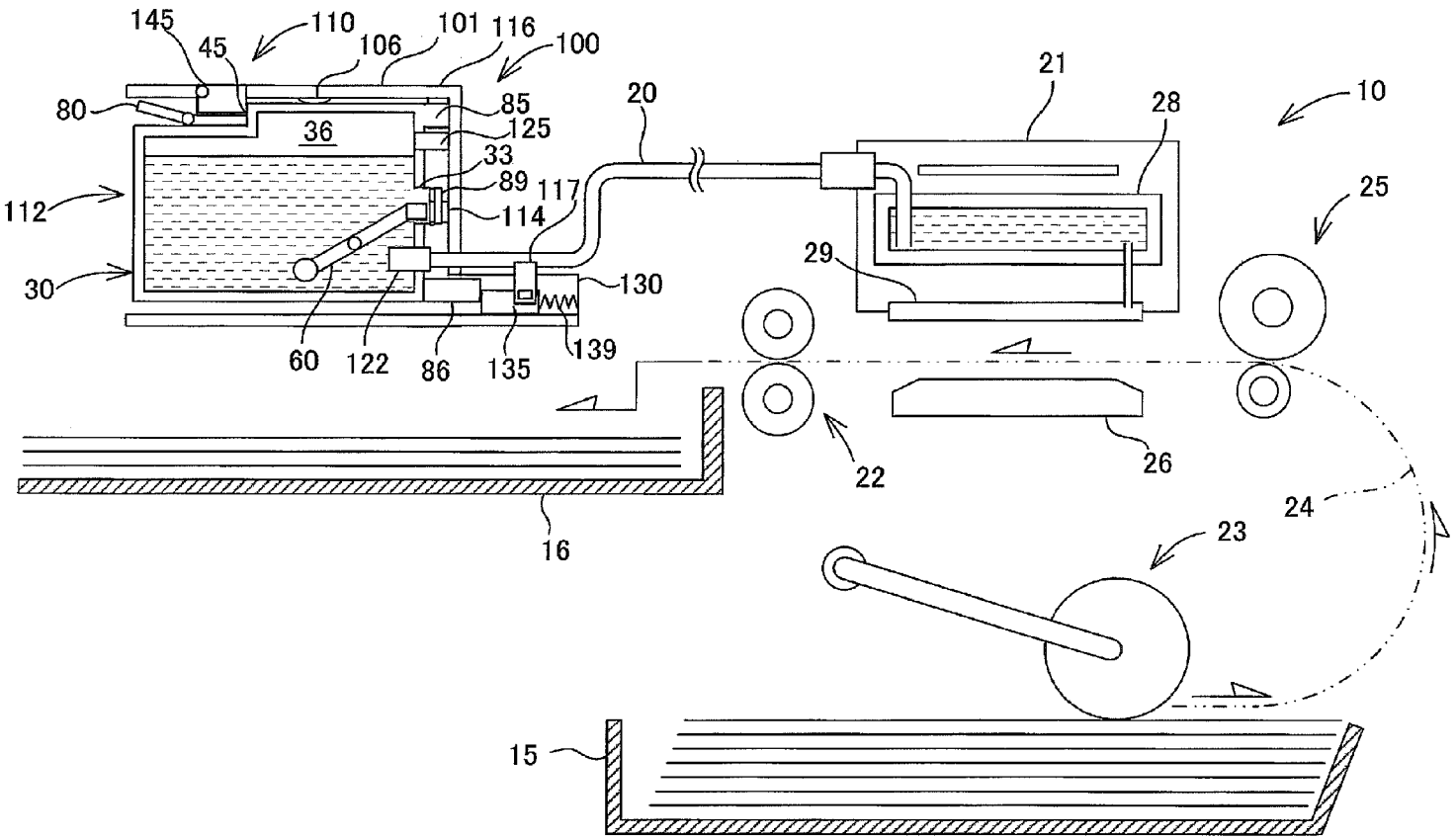
FIG. 1 is a schematic cross-sectional view schematically showing the internal configuration of a printer having a cartridge mounting unit according to an embodiment of the present invention.

A printing fluid cartridge according to an embodiment of the invention will be described while referring to the accompanying drawings wherein like parts and components are designated by the same reference numerals to avoid duplicating description.

Overview of the Printer

FIG. 1 shows a printer 10 employing an inkjet recording method for selectively ejecting ink droplets toward a recording sheet in order to record images on the sheet. The printer 10 is provided with an ink delivery device 100. The ink delivery device 100 has a cartridge mounting unit 110. An opening 112 is formed in one side of the cartridge mounting unit 110 for providing access to the interior of the cartridge mounting unit 110. Ink cartridges 30 can be mounted in the cartridge mounting unit 110 through the opening 112. More specifically, the ink cartridges 30 are inserted into and removed from the cartridge mounting unit 110 through the opening 112.

The ink cartridges 30 store ink usable by the printer 10. The printer 10 includes a recording head 21. Nozzles 29 are formed in the recording head 21. Sub tanks 28 are also provided in the recording head 21. The printer 10 also includes ink tubes 20 for connecting the recording head 21 to ink cartridges 30 mounted in the cartridge mounting unit 110. The sub tanks 28 temporarily store ink supplied from the ink cartridges 30 via the ink tubes 20. The recording head 21 selectively ejects ink supplied from the sub tanks 28 through the nozzles 29 according to an inkjet recording method.

The printer 10 further includes a sheet tray 15 accommodating recording sheets, a discharge tray 16 for receiving the recording sheets after a recording operation, a sheet-conveying path 24 that leads from the sheet tray 15 to the discharge tray 16, a platen 26 disposed along the sheet-conveying path 24 and confronting the recording head 21, a feeding roller 23 for feeding recording sheets from the sheet tray 15 onto the sheet-conveying path 24, and a pair of conveying rollers 25 disposed on the sheet-conveying path 24 for conveying the sheets over the platen 26. As the sheets pass over the platen 26, the recording head 21 selectively ejects ink droplets onto the recording sheet to record images thereon. The printer 10 includes a pair of discharge rollers 22 for receiving the recording sheets that have passed over the platen 26 and for discharging these sheets onto the discharge tray 16.

Ink Cartridges

Figure 2:
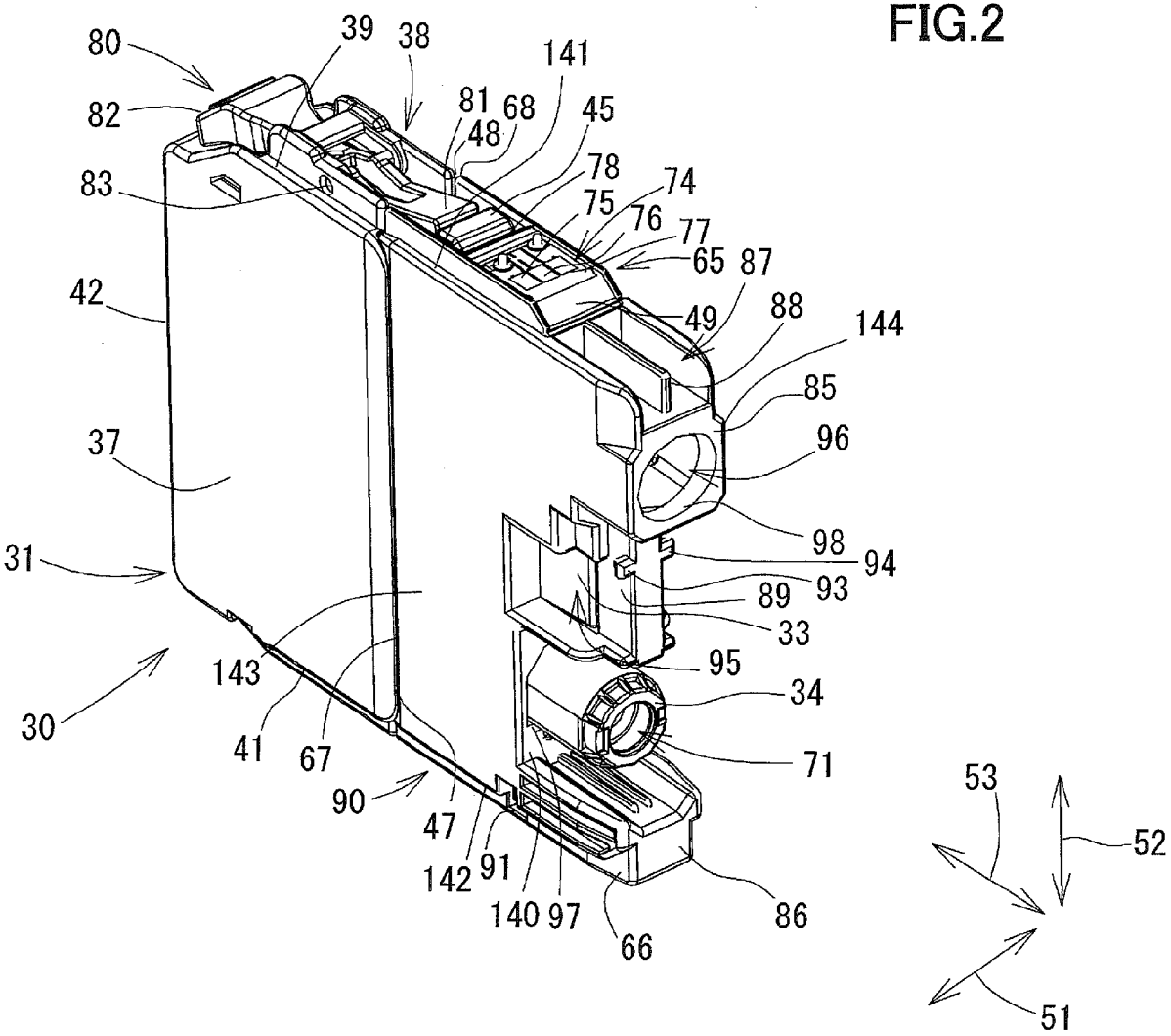
FIG. 2 is a perspective view showing an external appearance of an ink cartridge according to the embodiment.
Figure 3:
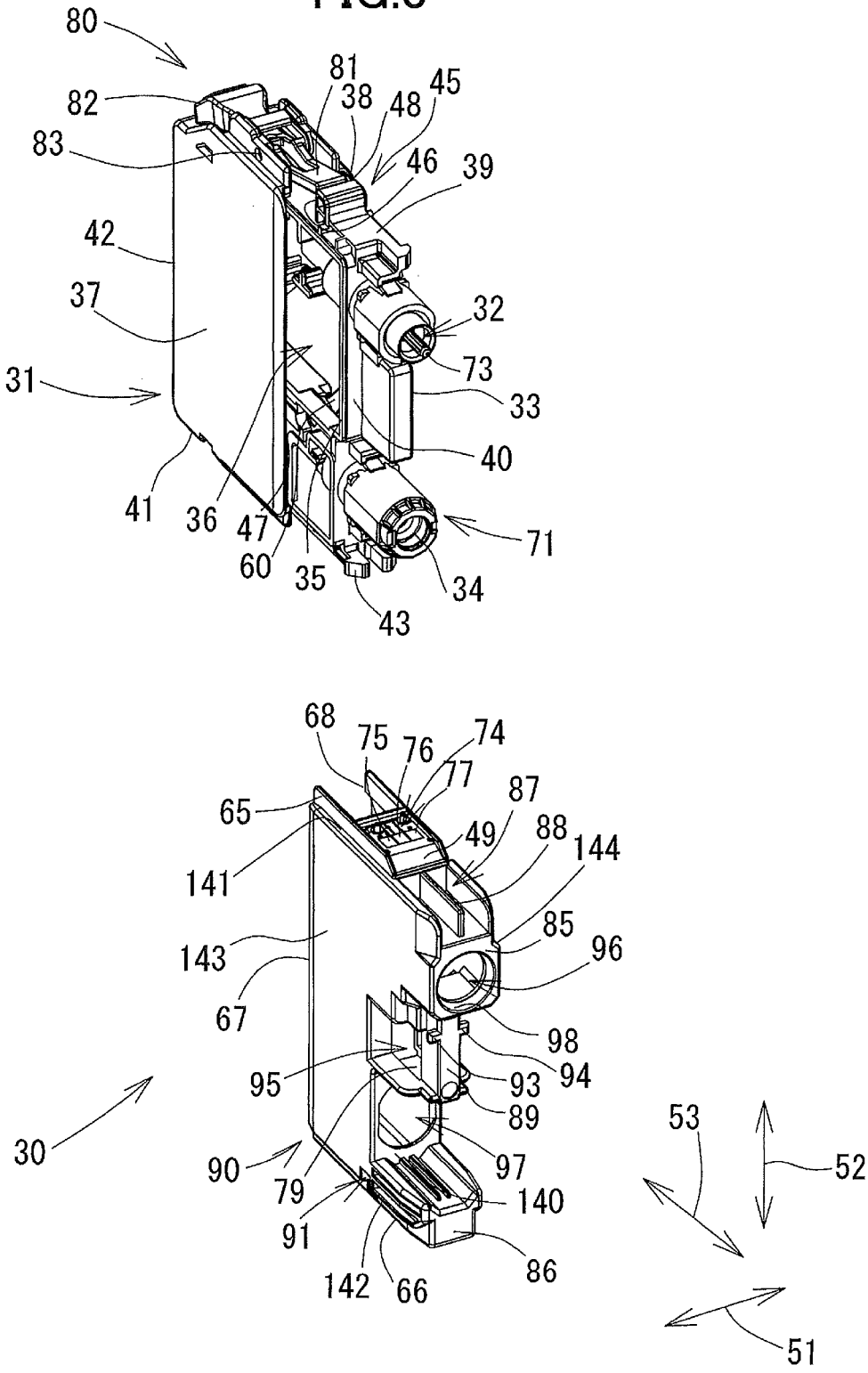
FIG. 3 is a perspective view showing a cartridge body and a bracket constituting the ink cartridge shown in FIG. 2 in the state that the cartridge body and bracket are disassembled from the ink cartridge.
Figure 4:
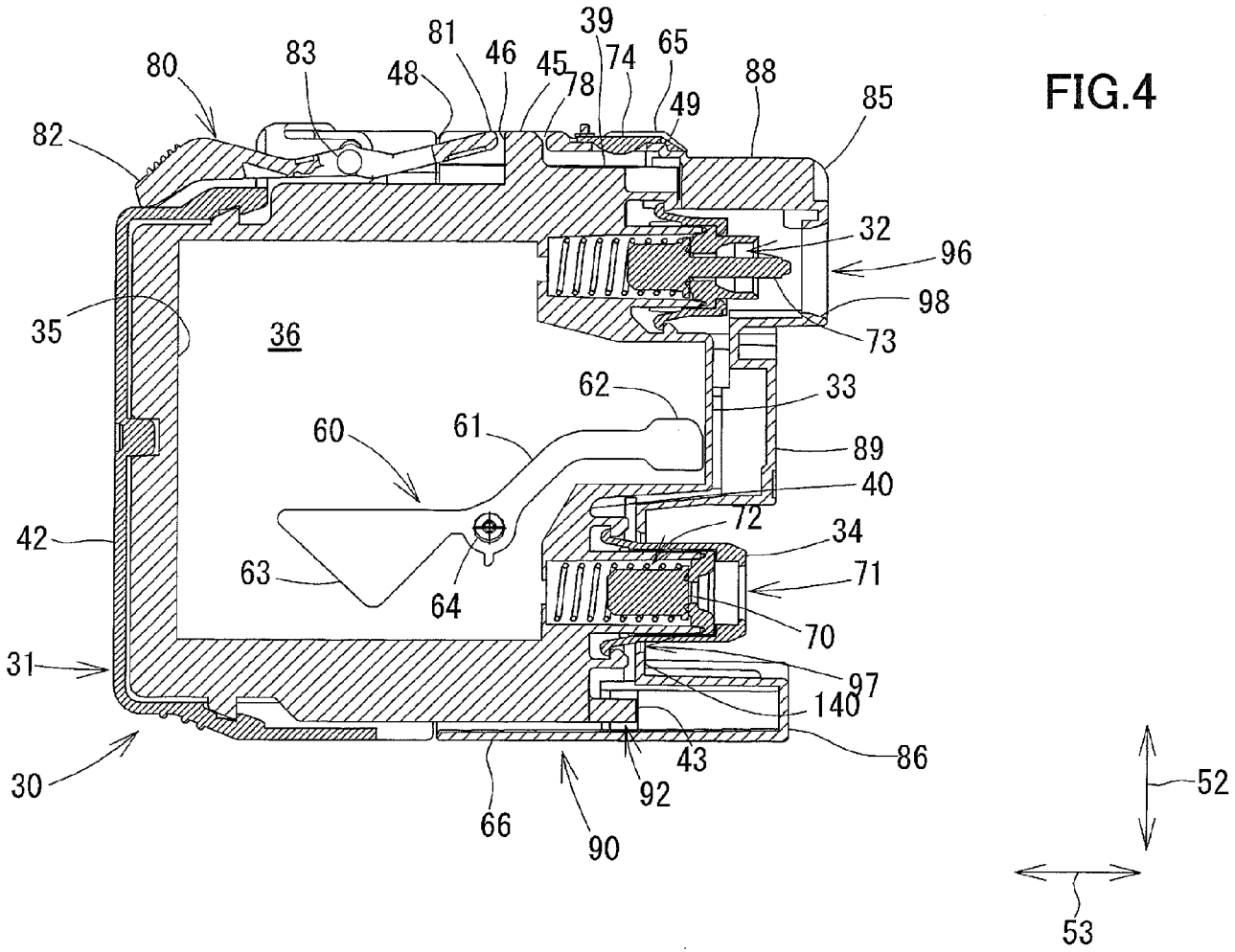
FIG. 4 is a cross-sectional view showing the internal configuration of the ink cartridge.

The ink cartridge 30 shown in FIGS. 2 through 4 is a receptacle for storing ink. A space formed inside the ink cartridge 30 serves as an ink chamber 36 for storing the ink. The ink cartridge 30 has a cartridge body 31 forming the outer shape of the ink cartridge 30, and an inner frame 35 separate from the cartridge body 31 for defining the ink chamber 36. It is noted that a film or a resin wall (not shown) is attached to the inner frame 35, thereby defining the ink chamber 36. However, the ink chamber 36 may alternatively be defined by the cartridge body 31 itself.

The ink cartridges 30 are detachably mounted in the cartridge mounting unit 110 in the erect state shown in FIGS. 2 through 4, i.e., so that the bottom surface in the drawings faces downward and the top surface faces upward. The ink cartridges 30 are inserted into and removed from the cartridge mounting unit 110 in directions indicated by arrows 50 (see FIG. 5; hereinafter referred to as "mounting and removing directions 50"). The mounting and removing directions 50 are horizontal directions. Thus, the ink cartridges 30 are inserted into and removed from the cartridge mounting unit 110 in their erect state. The erect state is equivalent to the mounting state. Of the mounting and removing directions 50, the direction for mounting the ink cartridge 30 in the cartridge mounting unit 110 is a mounting direction 56, and the direction for removing the ink cartridge 30 from the cartridge mounting unit 110 is a removing direction 55. In its erect state, the ink cartridge 30 has a height dimension aligned with vertical directions 52 corresponding to the gravitational direction. Hence, the ink cartridges 30 are inserted into and removed from the cartridge mounting unit 110 along the mounting and removing directions 50. Although the mounting and removing directions 50 are horizontal directions in the embodiment, the mounting and removing directions 50 may be aligned with the gravitational direction or may intersect both horizontal and gravitational directions.

As shown in FIGS. 2 through 4, each of the ink cartridges 30 includes the cartridge body 31, and a bracket 90 constituting the side of the ink cartridge 30 near a front wall 140 (described later). The ink cartridge 30 is assembled by mounting the bracket 90 on the cartridge body 31. Overall, the ink cartridge 30 has a slender shape, with a narrow width dimension aligned with left and right directions 51 and a larger height dimension aligned with the vertical directions 52 and a larger depth dimension aligned with front and rear directions 53. When the ink cartridge 30 is mounted in the cartridge mounting unit 110, the wall of the bracket 90 downstream in the mounting direction 56 is considered a front wall 140, while the wall of the cartridge body 31 upstream in the mounting direction 56 is considered a rear wall 42. Hence, the front wall 140 and the rear wall 42 constitute opposite sides of the ink cartridge 30 in the mounting and removing directions 50.

Cartridge Body

The cartridge body 31 has a generally rectangular parallelepiped shape. The outer surface of the cartridge body 31 is formed by a front wall 40, the rear wall 42, a pair of side walls 37 and 38 extending in the mounting and removing directions 50 from the rear wall 42 and elongated in the vertical directions 52, a top wall 39 connecting the side walls 37 and 38 and the front wall 40 and rear wall 42 and extending from the top edge of the front wall 40 toward the top edge of the rear wall 42, and a bottom wall 41 extending from the bottom edge of the front wall 40 toward the bottom edge of the rear wall 42.

Note that the depth dimension (front and rear directions 53) of the cartridge body 31 is aligned with the mounting and removing directions 50.

As shown in FIGS. 2 through 4, a sensing unit 33 is provided near the center of the front wall 40, opposing the front wall 140 formed by the bracket 90, with respect to the vertical directions 52. The sensing unit 33 is disposed farther upstream in the mounting direction 56 than (1) the end of a plate 88 in a first protrusion 85 described later, (2) the end of a second protrusion 86 described later relative to the mounting direction 56, and (3) a detection target 89 (described later). The sensing unit 33 has a box shape that is open on one side so as to be in communication with the ink chamber 36. The sensing unit 33 has a pair of walls formed of a transparent resin that are capable of transmitting light, such as infrared light, emitted from a photosensor 114 (see FIG. 6) in a direction orthogonal to the mounting and removing directions 50 (the left and right directions 51 in the embodiment). The sensing unit 33 is exposed on the outside of the ink cartridge 30 near the front wall 140 side through a hole 95 formed in the bracket 90. Therefore, light emitted from the photosensor 114 disposed outside the ink cartridge 30 can pass through the sensing unit 33. Note that this light may be infrared light or visible light.

The sensing unit 33 is hollow between its pair of left and right walls for accommodating ink. As shown in FIG. 4, a sensor arm 60 is disposed in the ink chamber 36. The sensor arm 60 includes a plate-shaped arm-like member 61, an indicator 62 disposed on one end of the arm-like member 61 relative to the front and rear directions 53 and positioned between the left and right walls of the sensing unit 33, and a floating part 63 disposed on the other end of the arm-like member 61. The sensor arm 60 is rotatably supported in the ink chamber 36 by a shaft 64 aligned with the left and right directions 51. The sensor arm 60 rotates based on the quantity of ink present in the ink chamber 36. Through the rotation of the sensor arm 60, the indicator 62 can be displaced between a lowermost position at the bottom of the sensing unit 33 in the gravitational direction, and an uppermost position in the top region of the sensing unit 33 above the lowermost position. The indicator 62 remains in the lowermost position, as shown in FIG. 4, while the ink in the ink chamber 36 remains above a prescribed level.

When the ink cartridge 30 is mounted in the cartridge mounting unit 110, the sensing unit 33 changes its state in relation to the photosensor 114 provided in the cartridge mounting unit 110 between a state of transmitting at least a prescribed amount of infrared light irradiated in a direction orthogonal to the mounting and removing directions 50 (the left and right directions 51 in the embodiment) and a state of shielding or attenuating the infrared light so as to transmit less than the prescribed amount. Since the sensing unit 33 transmits infrared light when the indicator 62 is in its uppermost position and shields or attenuates infrared light when the indicator 62 is in its lowermost position, it is possible to determine when the amount of residual ink in the ink chamber 36 falls below a prescribed amount based on the transmitting state of the sensing unit 33.

A residual ink detecting function can be implemented without providing the sensor arm 60 in the sensing unit 33. For example, the light-emitting element and light-receiving element of the photosensor 114 may be arranged in opposition to each other in a horizontal direction orthogonal to the mounting and removing directions 50 (i.e., in the left and right directions 51). With this configuration, light emitted from the light-emitting element travels in the horizontal direction orthogonal to the mounting and removing directions 50 and is received by the light-receiving element. Thus, infrared light emitted by the light-emitting element is blocked or attenuated by ink when ink is present in the sensing unit 33, and at least a prescribed amount of the infrared light is transmitted when ink is not present in the sensing unit 33.

Alternatively, the sensing unit 33 may be configured of a flexible film. A rotatable lever is disposed in contact with the film. When ink is present in the sensing unit 33, the film is distended and maintains the lever in a rotated position for shielding infrared light emitted by the light-emitting element. However, if ink is not present in the sensing unit 33, the film is contracted, allowing the lever to rotate downward or upward to a position that does not interfere with the infrared light. Alternatively, instead of the lever, a prism or the like may be provided to reflect infrared light emitted from the light-emitting element of the photosensor 114 so that the light does not reach the light-receiving element when ink is present in the sensing unit 33 and to reflect the infrared light so that the light is incident on the light-receiving element when ink is not present in the sensing unit 33.

An air hole 32 is formed in the front wall 40 of the cartridge body 31 above the sensing unit 33. The air hole 32 is a through-hole that penetrates the wall forming the ink chamber 36 in the front and rear directions 53 in order to allow communication between the airspace in the ink chamber 36 and the external air. The air hole 32 is disposed farther rearward than the front wall 140 constituting the bracket 90 toward the rear wall 42 constituting the cartridge body 31. A hole 96 penetrates the front wall 140 of the bracket 90 in the front and rear directions 53 to allow access to the air hole 32 from outside the ink cartridge 30. An air valve 73 is disposed in the air hole 32 for opening and closing the same. By opening the air hole 32, the negative pressure state of the ink chamber 36 can be equalized to atmospheric pressure. However, a film or the like may be used in place of the air valve 73 for sealing the air hole 32.

An ink delivery unit 34 is provided in the front wall 40 of the cartridge body 31 beneath the sensing unit 33. The exterior of the ink delivery unit 34 is cylindrical in shape and protrudes out from the front wall 140 of the bracket 90 in the mounting direction 56. An ink delivery port 71 is formed in the protruded end of the ink delivery unit 34. A hole 97 penetrates the front wall 140 of the bracket 90 in the front and rear directions 53. The ink delivery port 71 protrudes out of the ink cartridge 30 through the hole 97 and is exposed outside the ink cartridge 30.

An ink channel 72 is formed so as to extend in the mounting and removing directions 50 from the ink delivery port 71 through the interior of the ink delivery unit 34 to the ink chamber 36. An ink valve 70 is disposed in the ink delivery unit 34 for opening and closing the ink delivery port 71. An ink needle 122 (see FIG. 6) is provided in the cartridge mounting unit 110 for each of the ink cartridges 30. When an ink cartridge 30 is mounted in the cartridge mounting unit 110, the corresponding ink needle 122 is inserted into the ink delivery port 71 to open the ink valve 70. Through this configuration, ink in the ink chamber 36 can flow out through the ink channel 72 and into the ink needle 122 provided in the cartridge mounting unit 110.

Note that it is not necessary to provide a structure like the ink valve 70 for opening and closing the ink delivery port 71. For example, the ink delivery port 71 may be sealed with a piece of film or the like. When the ink cartridge 30 is mounted in the cartridge mounting unit 110, the ink needle 122 pierces the film, opening the ink delivery port 71.

As shown in FIGS. 3 and 4, an engaging pawl 43 is formed on the bottom wall 41 of the cartridge body 31. The distal end of the engaging pawl 43 protrudes outward in both left and right directions 51 of the ink cartridge 30. A notch extending in the front and rear directions 53 is formed in the center of the engaging pawl 43 with respect to the left and right directions 51. The notch allows the engaging pawl 43 to elastically deform in order to shrink its dimension in the left and right directions 51. The distal end of the engaging pawl 43 is inserted into elongate holes 91 and 92 (described later) formed in the bracket 90 and engages with the inner surfaces of the cylindrical inner walls defining the elongate holes 91 and 92.

An engaging part 45 is formed on the top wall 39 of the cartridge body 31 near the center thereof in the front and rear directions 53. The engaging part 45 has an engaging surface 46 extending in both the left and right directions 51 and the vertical directions 52, and protrudes upward from the top wall 39. When the ink cartridge 30 is mounted in the cartridge mounting unit 110, an engaging member 145 described later is engaged with the engaging surface 46. The engaging part 45 is subjected to an urging force for pressing the ink cartridge 30 in the removing direction 55.

A rotary member 80 is provided above the cartridge body 31 with respect to the vertical directions 52 at the rear wall 42 side. The rotary member 80 is formed in a bent plate shape, for example, with its longitudinal dimension aligned with the front and rear directions 53. The rotary member 80 has a shaft 83 in its bent portion. The shaft 83 is rotatably supported in a position separated from the engaging surface 46 of the cartridge body 31 toward the rear wall 42. The rotary member 80 can rotate about the shaft 83. The end of the rotary member 80 on the front wall 40 side is a front portion 81 that extends from the shaft 83 toward the engaging surface 46. The end of the rotary member 80 on the rear wall 42 side is a rear portion 82 that extends from the shaft 83 toward the rear wall 42.

When no external force is applied to the rotary member 80, the rotary member 80 is oriented by its own weight such that the front portion 81 is in its highest position relative to the top wall 39 (in a position farthest separated from the top wall 39). In this state, the rear portion 82 is positioned above the top wall 39 of the cartridge body 31. The front portion 81 is configured so as to protrude outward from the exterior of the cartridge body 31. When the front portion 81 of the rotary member 80 is pressed downward, the rotary member 80 rotates clockwise in FIG. 4 against its own weight. When the rotary member 80 has rotated clockwise as far as possible, the front portion 81 is positioned at the bottom of the engaging surface 46. The rotary member 80 may also be integrated with the cartridge body 31. A coil spring may also be provided for urging the rotary member 80 in the clockwise direction. With this construction, the rotary member 80 can rotate counterclockwise against the urging force of the coil spring when the rear portion 82 is pressed downward.

The side walls 37 and 38 of the cartridge body 31 expand from the approximate center of the cartridge body 31 with respect to the front and rear directions 53 to the rear wall 42 side. Specifically, the outer surfaces of the side walls 37 and 38 are flat from the rear wall 42 to a midpoint toward the front wall 40 side, then taper inward from the midpoint to the edges of the side walls 37 and 38, forming sloped surfaces 47 and 48, respectively, that slope relative to the front and rear directions 53. Hence, the side walls 37 and 38 do not extend all the way to the front wall 40 from the center of the cartridge body 31 with respect to the front and rear directions 53, exposing the inner frame 35 that defines the ink chamber 36. The sloped surfaces 47 and 48 provided in the center of the cartridge body 31 with respect to the front and rear directions 53 extend along the entire cartridge body 31 in the vertical directions 52 and taper inward a distance equivalent to the thickness of the respective side walls 37 and 38. The bracket 90 described next covers the cartridge body 31 and inner frame 35 on the front wall 40 side of the sloped surfaces 47 and 48.

Bracket

The bracket 90 is a slender receptacle capable of covering the front wall 40 side of the cartridge body 31, the side surfaces of the cartridge body 31 on the front wall 40 side of the sloped surfaces 47 and 48 formed respectively in the side walls 37 and 38, and the top wall 39 and bottom wall 41 on the front wall 40 side of the sloped surfaces 47 and 48. The bracket 90 has the front wall 140 mentioned earlier, a top wall 141, a bottom wall 142, and a pair of side walls 143 and 144. When the bracket 90 is assembled to the cartridge body 31, the front wall 140 of the bracket 90 confronts the front wall 40 of the cartridge body 31, the top wall 141 confronts the top wall 39, the bottom wall 142 confronts the bottom wall 41, and the side walls 143 and 144 and the side walls 37 and 38 are approximately aligned with each other in the front and rear directions 53 and the edges of the side walls 143 and 144 overlap the edges of the side walls 37 and 38. The bracket 90 has an opening on the side opposite the front wall 140 that is defined by the top wall 141, bottom wall 142, and side walls 143 and 144. The bracket 90 is mounted on the cartridge body 31 by inserting the portion of the cartridge body 31 on the front wall 40 side through the opening of the bracket 90 into its internal space. Note that the opening in the bracket 90 need not be defined by the top wall 141, bottom wall 142, and side walls 143 and 144. For example, the side walls 143 and 144 may be eliminated to configure a bracket 90 having only the top wall 141 and bottom wall 142 connected to the front wall 140. In such a case, the side walls 37 and 38 need to extend all the way from the rear wall 42 to the front wall 40 in the front and rear directions 53.

The elongate holes 91 and 92 extending in the vertical directions 52 are formed in the bottom edges of the side walls 143 and 144 constituting the bracket 90. When the bracket 90 is mounted on the cartridge body 31, the distal ends of the engaging pawl 43 are inserted respectively into the elongate holes 91 and 92. The dimension of the engaging pawl 43 in the vertical directions 52 is shorter than that of the elongate holes 91 and 92. Edge portions 67 and 68 of the bracket 90 on the open side extend in the vertical directions 52. When the bracket 90 is mounted on the cartridge body 31, the edge portions 67 and 68 are positioned just inside the sloped surfaces 47 and 48 of the side walls 37 and 38 constituting the cartridge body 31 and confront the sloped surfaces 47 and 48 (i.e., overlap the sloped surfaces 47 and 48) in the left and right directions 51. The engaging pawl 43 can slide within the elongate holes 91 and 92, enabling the bracket 90 to be moved in the vertical directions 52 relative to the cartridge body 31. Hence, the range with which the bracket 90 can slide relative to the cartridge body 31 in the vertical directions 52 is established by the gap formed between the engaging pawl 43 and the inner walls configuring the elongate holes 91 and 92 in the vertical directions 52. When the bracket 90 is moved relative to the cartridge body 31, the edge portions 67 and 68 of the bracket 90 slide against the sloped surfaces 47 and 48 of the cartridge body 31. In other words, the sloped surfaces 47 and 48 guide the bracket 90 when the bracket 90 moves in the vertical directions 52 so that the bracket 90 can be moved relative to the cartridge body 31 in directions for bringing the top wall 141 of the bracket 90 into contact with and separating the top wall 141 from the top wall 39 of the cartridge body 31.

The hole 95 is formed in the front wall 140 side of the bracket 90, penetrating the bracket 90 in the left and right directions 51 at the approximate center with respect to the vertical directions 52. When the bracket 90 is mounted on the cartridge body 31, the hole 95 functions as a window for exposing the sensing unit 33 of the cartridge body 31. Hence, the hole 95 is formed at a position and of a shape and dimensions corresponding to the sensing unit 33 of the cartridge body 31. The frame of the hole 95 is configured to surround the sensing unit 33 and includes the detection target 89 extending in the vertical directions 52 and a receiving part 79 extending from the bottom end of the detection target 89 and elongated in the front and rear directions 53 for receiving the sensing unit 33. A gap is formed between the receiving part 79 and sensing unit 33 when the bracket 90 is supported on the top wall 39 of the cartridge body 31. The receiving part 79 contacts the bottom edge of the sensing unit 33 when the bracket 90 is moved upward. In other words, the receiving part 79 restricts the range in which the bracket 90 can move vertically upwardly relative to the cartridge body 31. In the embodiment, the receiving part 79 restricts the range in which the bracket 90 can move upward relative to the cartridge body 31, but the range in which the bracket 90 can move upward relative to the cartridge body 31 may be restricted to the range within which the engaging pawl 43 is engaged in the cylindrical inner walls forming the elongate holes 91 and 92.

The hole 96 is formed in the front wall 140 of the bracket 90 near the top of the front wall 140 in the vertical directions 52 and penetrates the front wall 140 in the front and rear directions 53. When the bracket 90 is mounted on the cartridge body 31, the hole 96 provides access to the air hole 32 of the cartridge body 31. Hence, the hole 96 is formed at a position and of a shape and dimensions corresponding to the air hole 32 of the cartridge body 31.

The hole 97 is formed in the front wall 140 of the bracket 90 near the bottom with respect to the vertical directions 52 and penetrates the front wall 140 in the front and rear directions 53. When the bracket 90 is mounted on the cartridge body 31, the hole 97 functions to expose the ink delivery unit 34 of the cartridge body 31 on the outside of the ink cartridge 30. Therefore, the hole 97 is formed at a position and of a shape and dimensions corresponding to the ink delivery unit 34 of the cartridge body 31.

The first protrusion 85 and the second protrusion 86 are provided on the front wall 140 side of the bracket 90. The first protrusion 85 is provided on the top end of the front wall 140 and extends away from the front wall 140 (in the mounting direction 56). The first protrusion 85 has the same width as the front wall 140. The first protrusion 85 protrudes away from the front wall 140 (in the mounting direction 56) to a position farther forward than the distal end of the ink delivery unit 34 (the ink delivery port 71). Although the first protrusion 85 has a width equivalent to the front wall 140 in the embodiment, the first protrusion 85 may be a plate-shape, whose width in the left and right directions 51 and height in the vertical directions 52 are both smaller than the width and the height of the front wall 140. A groove 87 extending in the front and rear directions 53 is formed in the center of the first protrusion 85 with respect to the left and right directions 51. The groove 87 is open on the top with respect to the vertical directions 52 and on the downstream side in the mounting direction 56. A cross section of the groove 87 taken along the vertical directions 52 and left and right directions 51 is shaped like a square depression.

A plate 88 is provided in the internal space of the groove 87 at the center of the groove 87 in the left and right directions 51. The plate 88 is erected upward from the bottom surface of the groove 87 and is elongated in the front and rear directions 53. The side surfaces of the plate 88 with respect to the left and right directions 51 oppose and are parallel to respective side surfaces forming the groove 87. The plate 88 blocks or attenuates light, such as infrared light, emitted by a photosensor 116 in the left and right directions 51, enabling the photosensor 116 to detect the plate 88. The dimension of the plate 88 in the mounting direction 56 (i.e., the degree to which the plate 88 protrudes away from the front wall 140) varies according to the type of ink cartridge 30. Different types of ink cartridges 30 store inks of different color and composition and initially hold different quantities of ink in the ink chamber 36.

The second protrusion 86 is provided on the bottom end of the front wall 140 constituting the bracket 90. Hence, the second protrusion 86 is positioned below the ink delivery unit 34. The second protrusion 86 has the same width as the front wall 140 and protrudes away from the front wall 140 (in the mounting direction 56). The distal end of the second protrusion 86 protrudes to a position farther forward than the distal end of the ink delivery unit 34 (i.e., the ink delivery port 71). The dimension of the second protrusion 86 in the direction away from the front wall 140 (the mounting direction 56) varies according to the type of ink cartridge 30. Different types of ink cartridges 30 store inks of different color and composition and initially hold different quantities of ink in the ink chamber 36. While the second protrusion 86 is indirectly detected in the cartridge mounting unit 110 according to the embodiment, a rib similar to the plate 88 of the first protrusion 85 may be provided on the second protrusion 86, and a photosensor 117 (see FIG. 1) may be provided for directly detecting the rib of the second protrusion 86.

In the bracket 90, the detection target 89 is positioned on the front side of the front wall 140 with respect to the front and rear directions 53, and is positioned between the first protrusion 85 and second protrusion 86 with respect to the vertical directions 52. The detection target 89 is disposed on the front side of the sensing unit 33 (the downstream side in the mounting direction 56) for blocking or attenuating infrared light or other light traveling along the left and right directions 51. The detection target 89 has substantially the same dimension as the sensing unit 33 in the left and right directions 51. That is, the detection target 89 is sufficiently narrow to be inserted between the light-emitting element and light-receiving element of the photosensor 114. The detection target 89 may alternatively be configured of a light-transmissive resin functioning as part of the sensing unit 33. In this case, the detection target 89 has a thickness in the left and right directions 51 sufficient for attenuating infrared light. Alternatively, the light-transmissive resin may have a thickness sufficient for attenuating or reflecting infrared light or may include a colorant.

The detection target 89 and sensing unit 33 are spaced apart in the front and rear directions 53 by a prescribed distance or gap. This distance is sufficient to allow transmission of infrared light in the left and right directions 51 without attenuating the light below a prescribed intensity. The dimension of the detection target 89 along the front and rear directions 53 varies according to the type of ink cartridge 30. Different types of ink cartridges 30 store inks of different color, inks of different composition, such as pigment or dye, and initially hold different quantities of ink in the ink chamber 36.

Protruding parts 93 and 94 are provided on the front side of the detection target 89 so as to protrude respectively outward in the left and right directions 51, without protruding farther outward than the front wall 140 of the bracket 90. A hook 162 of a release unit 150 described later (see FIG. 13) engages with the protruding parts 93 and 94.

The first protrusion 85, second protrusion 86, and detection target 89 all protrude further away from the front wall 140 (in the mounting direction 56) than the sensing unit 33. That is, the first protrusion 85, second protrusion 86, and detection target 89 are disposed on the ink cartridge 30 forward of the sensing unit 33 in the mounting direction 56, while the sensing unit 33 is disposed closer to the front wall 140 (on the upstream side of the mounting direction 56) than the first protrusion 85, second protrusion 86, and detection target 89. The sensing unit 33 and ink delivery port 71 are both positioned between the first protrusion 85 and second protrusion 86 with respect to the vertical directions 52.

A guide part 65 is provided along the top wall 39 of the cartridge body 31 and the top wall 141 of the bracket 90, extending in the front and rear directions 53. The guide part 65 is configured of a pair of ribs protruding upward from the top wall 39 and top wall 141. The guide part 65 is provided both on the cartridge body 31 and bracket 90 and extends continuously in the front and rear directions 53 when the bracket 90 is mounted on the cartridge body 31. The pair of ribs constituting the guide part 65 are separated in the left and right directions 51 by a distance shorter than that between the side walls 37 and 38 of the cartridge body 31 and between the side walls 143 and 144 of the bracket 90, but is wider than the width of the engaging member 145 described later. The downstream end of the guide part 65 in the mounting direction 56 is on the rear wall 42 side of the groove 87 formed in the first protrusion 85.

A guide part 66 is provided along the bottom wall 41 of the cartridge body 31 and the bottom wall 142 of the bracket 90 extending in the front and rear directions 53. The guide part 66 is configured of a pair of protruding parts that protrude downward from the bottom walls 41 and 142. The guide part 66 is provided on each of the cartridge body 31 and bracket 90 and extends continuously along the front and rear directions 53 when the bracket 90 is mounted on the cartridge body 31. The gap between the pair of protruding parts of the guide part 66 opposing each other in the left and right directions 51 is smaller than the distance between the side walls 37 and 38 of the cartridge body 31 and the side walls 143 and 144 of the bracket 90. The gap between the pair of protruding parts constituting the guide part 66 in the left and right directions 51 is larger than the width of the engaging member 145 described later. When the ink cartridge 30 is inserted into and removed from the cartridge mounting unit 110, the guide parts 65 and 66 are guided by guide grooves 109 described later.

A IC chip 74 is provided between the pair of ribs constituting the guide part 65 of the bracket 90. The IC chip 74 is positioned on the rear wall 42 side of the groove 87 and the front wall 40 side of the engaging part 45. Hence, the IC chip 74 is disposed in the top wall 141 side of the bracket 90. The IC chip 74 forms an electrical connection with three contacts 106 (see FIG. 6) juxtaposed in the left and right directions 51 while the ink cartridge 30 is mounted partway into the cartridge mounting unit 110, and maintains the electrical connection with the contacts 106 after the ink cartridge 30 is fully mounted in the cartridge mounting unit 110.

The IC chip 74 has mounted thereon an integrated circuit (IC; not shown), a "hot" electrode 75, a ground electrode 76, and a signal electrode 77. The IC is a semiconductor IC for storing readable data indicating information related to the ink cartridge 30, such as its lot number, manufacture date, ink color, and the like.

The "hot" electrode 75, ground electrode 76, and signal electrode 77 are electrically connected to the IC. The "hot" electrode 75, ground electrode 76, and signal electrode 77 are juxtaposed and separated from each other in the left and right directions 51 and elongated in the front and rear directions 53. The "hot" electrode 75, ground electrode 76, and signal electrode 77 are exposed on the top surface of the IC chip 74 so as to be electrically accessible. That is, these components are exposed and accessible from the top of the ink cartridge 30 when the ink cartridge 30 is in its mounted state.

A sloped member 49 is provided on the rear wall 42 side of the groove 87 and the front wall 40 side of the IC chip 74. The sloped member 49 bridges the pair of ribs constituting the guide part 65 of the bracket 90. The sloped member 49 has a sloped surface that slopes downward toward the mounting direction 56. The ribs in the guide part 65 protrude above the IC chip 74 and extend to a downstream side of the IC chip 74 in the mounting direction 56. That is, the ribs protrude further outward than the IC chip 74.

A recess 78 is formed in the top of the ink cartridge 30 in a border region in which the engaging part 45 opposes the bracket 90. This recess 78 allows the bracket 90 to be flush with the engaging part 45 in the border region. Consequently, as the ink cartridge 30 is mounted into the cartridge mounting unit 110, the engaging member 145 slides over the top surface of the ink cartridge 30 without catching on components in the border region.

Figure 10B:
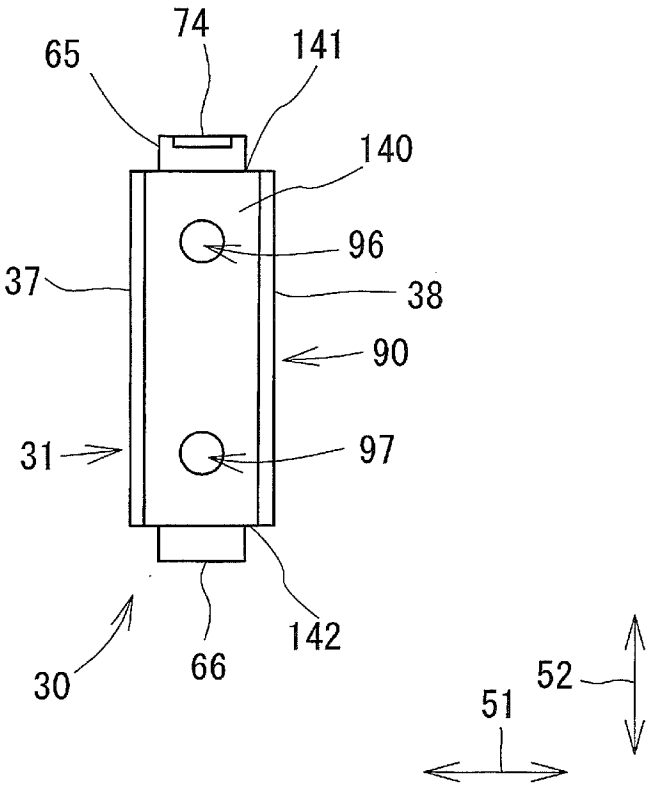
FIGS. 10A and 10B are respectively a side view and a front view of an ink cartridge according to a modification.
Figure 10A:
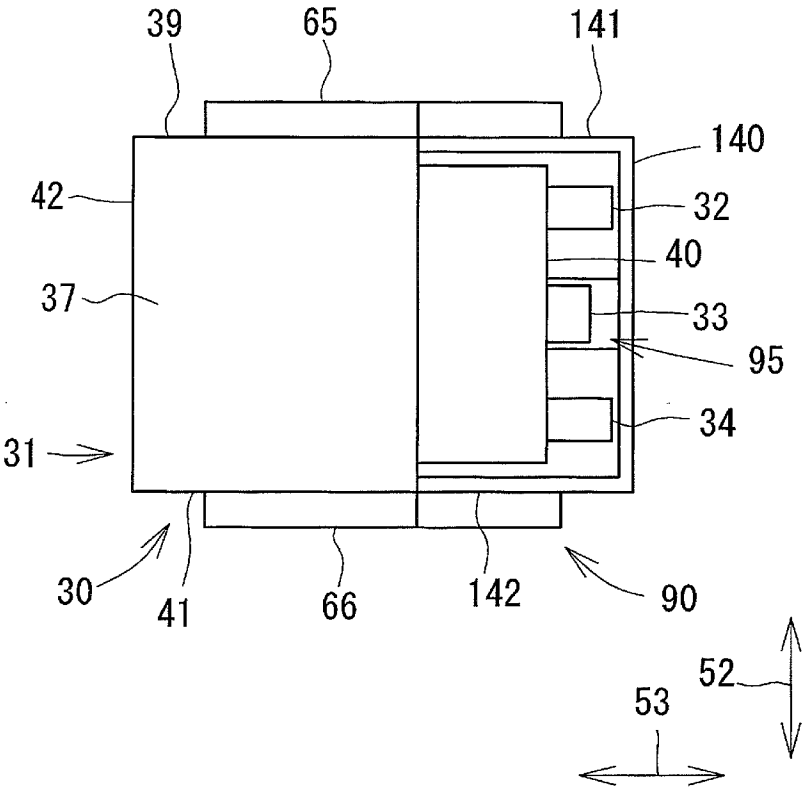
Figure 11B:
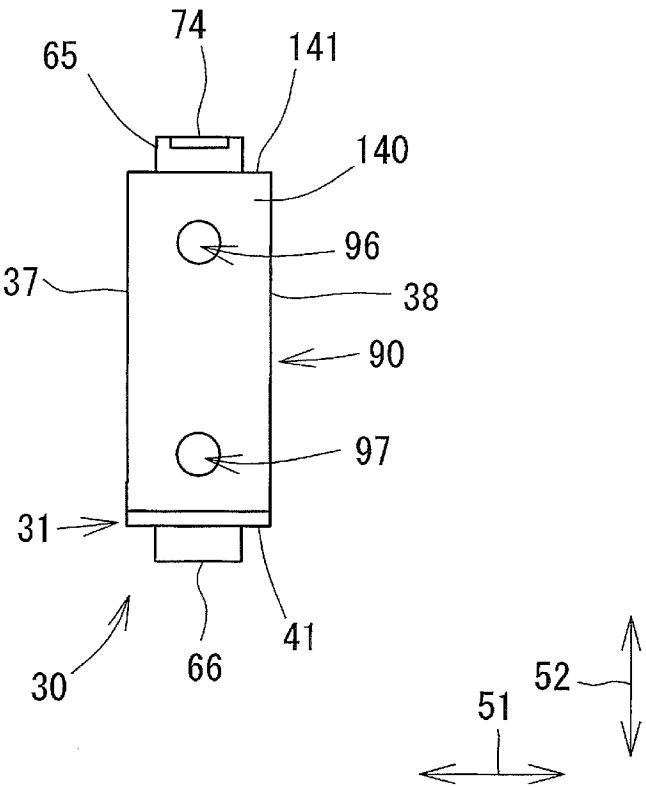
FIGS. 11A and 11B are respectively a side view and a front view of an ink cartridge according to another modification.
Figure 11A:
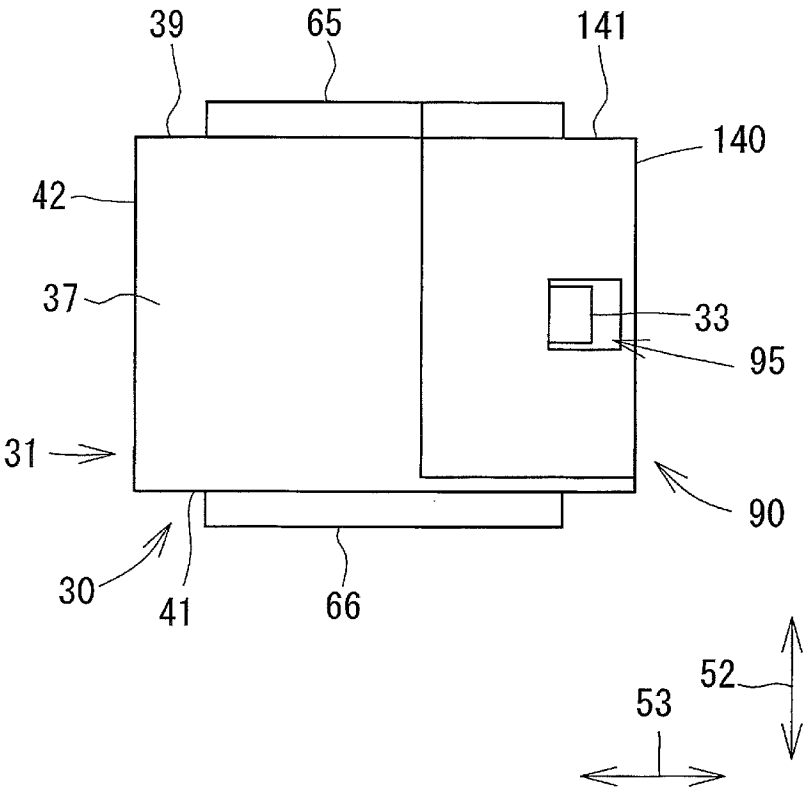
Figure 12:
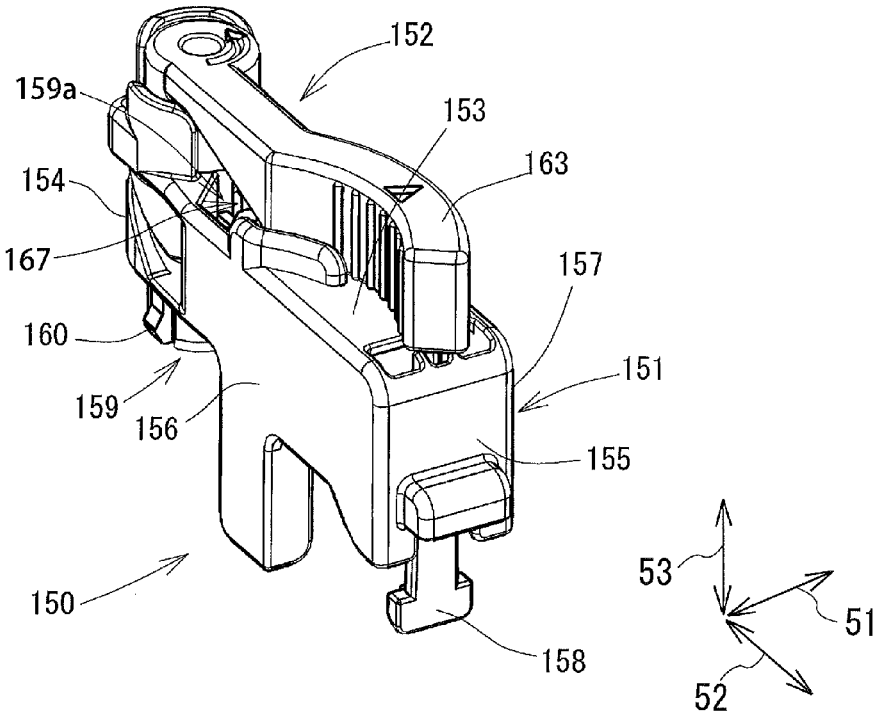
FIG. 12 is a perspective view showing an external appearance of a release unit according to the embodiment.

While the bracket 90 is formed to cover parts of the front wall 40, top wall 39, bottom wall 41, and to cover parts of the side surfaces of the cartridge body 30 so that the edges of the side walls 37 and 38 overlap the edges 67 and 68 of the bracket 90, the bracket 90 may be shaped to cover any surfaces of the cartridge body 31. For example, the bracket 90 may be shaped so as not to cover the side surfaces of the cartridge body 31, as shown in FIGS. 10A and 10B, and may be shaped to not cover the bottom wall 41 of the cartridge body 31, as shown in FIGS. 11A and 11B.

Ink Delivery Device

As shown in FIG. 1, the printer 10 is provided with the ink delivery device 100. The ink delivery device 100 serves to deliver ink to the recording head 21 provided in the printer 10. The ink delivery device 100 includes the cartridge mounting unit 110 in which the ink cartridges 30 are detachably mountable. FIG. 1 shows the state of the ink delivery device 100 when an ink cartridge 30 is mounted in the cartridge mounting unit 110.

Cartridge Mounting Unit

Figure 5:
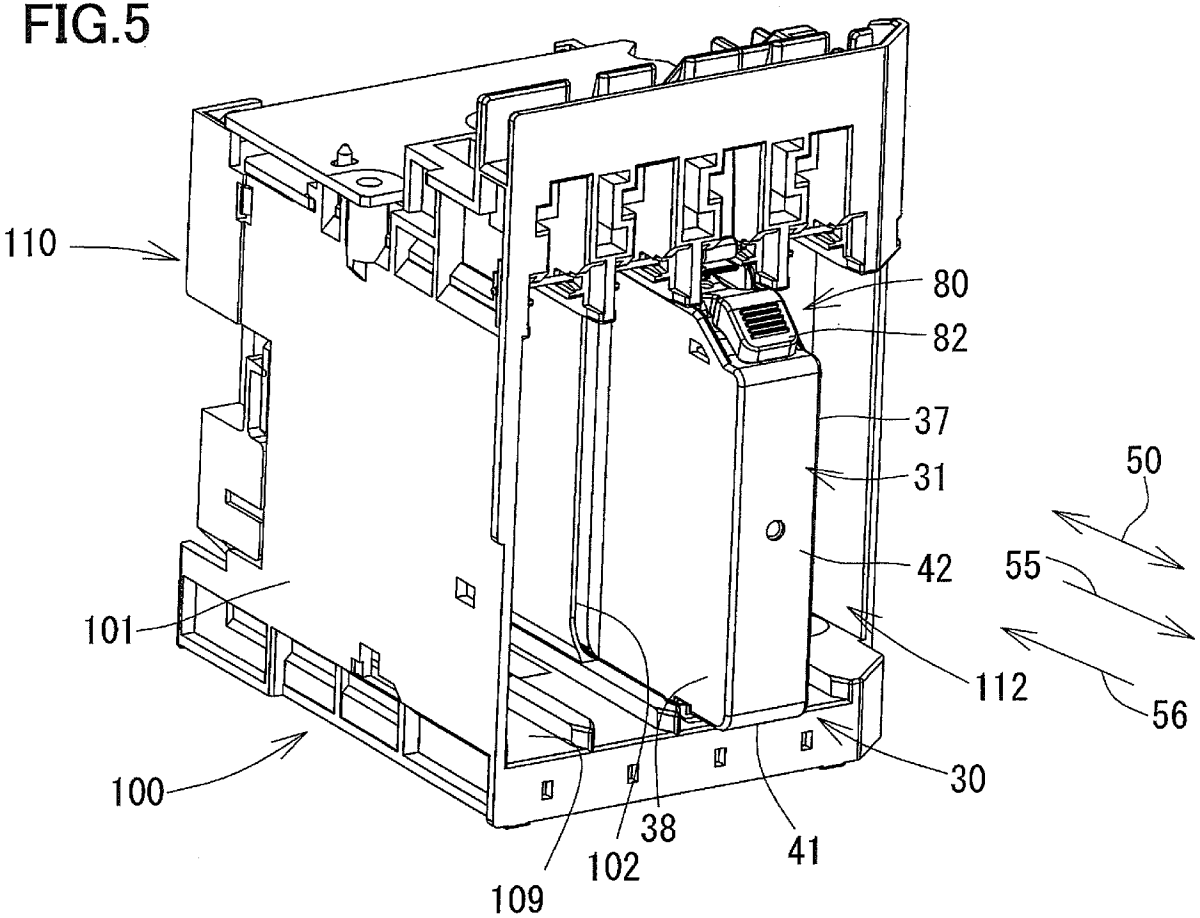
FIG. 5 is a perspective view showing the configuration of the cartridge mounting unit.

As shown in FIGS. 5 and 6, the ink delivery device 100 has a case 101 forming the outer shell of the cartridge mounting unit 110. The opening 112 is formed in the case 101 on the front side of the printer 10. The ink cartridges 30 are inserted into and removed from the case 101 through the opening 112. Four guide grooves 109 are provided in the top inner surface of the case 101 defining the top of its internal space, while corresponding guide grooves 109 are provided in the bottom inner surface of the case 101 defining the bottom of its internal space. When mounting or removing an ink cartridge 30, the guide part 65 is inserted into the corresponding guide groove 109 formed in the top surface while the guide part 66 is inserted into the corresponding guide groove 109 formed in the bottom surface for guiding the ink cartridge 30 in the mounting and removing directions 50. Four ink cartridges 30 accommodating the corresponding colors cyan, magenta, yellow, and black can be mounted in the case 101.

Three plates 102 are provided in the case 101 for partitioning the internal space of the case 101 in the left and right directions 51 into four spaces elongated vertically. One ink cartridge 30 is accommodated in each space partitioned by the plates 102.

As shown in FIG. 6, connectors 103 are provided on the inner back surface of the case 101 near the bottom thereof. The connectors 103 are disposed at positions on the inner back surface corresponding to the ink delivery units 34 of the ink cartridges 30 when the ink cartridges 30 are mounted in the case 101. In the embodiment, four connectors 103 are provided for the four ink cartridges 30 that can be accommodated in the case 101.

Each of the connectors 103 includes the ink needle 122, and a retaining part 121. The ink needle 122 is a tube-like needle formed of a resin. The ink needle 122 connects to a corresponding ink tube 20 on the opposite side of the back wall forming the inner back surface of the case 101 (i.e., on the outer back surface side). The ink tube 20 runs from the ink needle 122 on the outer back surface side of the back wall to the recording head 21 in the printer 10 for supplying ink thereto. Note that the ink tubes 20 have been omitted from FIGS. 5 and 6.

The retaining part 121 has a cylindrical shape. The ink needle 122 is provided in the center of the retaining part 121. As shown in FIG. 9, the ink delivery unit 34 is inserted inside the cylindrical retaining part 121 when the ink cartridge 30 is mounted in the cartridge mounting unit 110. As the ink delivery unit 34 is inserted, the ink delivery unit 34 becomes positioned relative to the retaining part 121 through contact between the outer peripheral surface of the ink delivery unit 34 and the inner peripheral surface of the retaining part 121. As the ink delivery unit 34 is inserted into the retaining part 121, the ink needle 122 is inserted into the ink delivery port 71 of the ink delivery unit 34. The ink needle 122 contacts and pushes the ink valve 70 open, allowing ink stored in the ink chamber 36 to flow into the ink needle 122.

As shown in FIG. 6, a sensor unit 104 is provided on the back surface of the case 101 above the connectors 103 with respect to the vertical directions 52. The sensor unit 104 includes a substrate 113, and photosensors 114. The sensor unit 104 is assembled by mounting the photosensors 114 on the substrate 113. Four photosensors 114 are provided in the sensor unit 104 to correspond to the four ink cartridges 30 that can be accommodated in the case 101. The photosensors 114 are arranged at intervals along the width dimension of the case 101 (in the left and right directions 51) so that each of the plates 102 is positioned between adjacent photosensors 114.

The photosensor 114 has a light-emitting element, such as an LED, and a light-receiving element, such as a phototransistor. The light-emitting element and light-receiving element are both set in a package, which gives the photosensor 114 a horseshoe shape. In the embodiment, the light-emitting element can irradiate light from one side of the package in a horizontal direction orthogonal to the mounting and removing directions 50 (the left and right directions 51). The light-receiving element receives the irradiated light on the other side of the package. Hence, the light-emitting element and light-receiving element are positioned in opposition with each other in the horizontal direction orthogonal to the mounting and removing directions 50 with a prescribed gap formed therebetween. The sensing unit 33 and the detection target 89 of the ink cartridge 30 can be inserted in the gap between the light-emitting element and light-receiving element. When either the sensing unit 33 or the detection target 89 advances into the optical path of the photosensor 114, the photosensor 114 can detect a change in the amount of transmitted light based on the sensing unit 33 or detection target 89.

As shown in FIG. 6, a sensor unit 105 is provided on the inner top surface of the case 101 near the inner back surface thereof. The sensor unit 105 is provided with a substrate 115, and the photosensors 116. The sensor unit 105 is assembled by mounting the photosensors 116 on the substrate 115. Four of the photosensors 116 are provided in the sensor unit 105 to correspond to the four ink cartridges 30 that can be accommodated in the case 101. The photosensors 116 are arranged at intervals along the width direction of the case 101 (the left and right directions 51) so that one of the plates 102 is positioned between pairs of adjacent photosensors 116.

When the ink cartridge 30 is mounted in the case 101, the plate 88 of the first protrusion 85 advances into the optical path of the corresponding photosensor 116. Accordingly, the printer 10 can determine when the ink cartridge 30 is in its mounted state by detecting a change in the signal of the photosensor 116 at this time. The photosensor 116 also has a light-emitting element and a light-receiving element. However, since this configuration is similar to that of the photosensor 114, a detailed description will not be provided for the photosensor 116.

As shown in FIG. 6, contacts 106 are provided on the inner top surface of the case 101 between the opening 112 and the inner back surface of the case 101. Three contacts 106 are arranged at intervals along the left and right directions 51 orthogonal to the mounting and removing directions 50. The positions of the contacts 106 correspond to the "hot" electrode 75, ground electrode 76, and signal electrode 77. Each of the contacts 106 is configured of an elastic member having electrical conductivity and is capable of elastically deforming upward with respect to the vertical directions 52. Four sets of the three contacts 106 are provided to correspond to the four ink cartridges 30 that can be accommodated in the case 101.

Each of the contacts 106 is electrically connected to an arithmetic unit through an electric circuit. The arithmetic unit includes a CPU, ROM, and RAM, for example, and may serve as the control unit of the printer 10. A voltage Vc is applied to the "hot" electrode 75 through electrical contact between one of the contacts 106 and the "hot" electrode 75. The ground electrode 76 is grounded by forming electrical contact between one of the contacts 106 and the ground electrode 76. Power is supplied to the IC by electrically connecting the contacts 106 to the "hot" electrode 75 and ground electrode 76. The CPU of the arithmetic unit can access data stored on the integrated circuit when the signal electrode 77 is electrically connected to one of the contacts 106. Output from the electric circuit is inputted into the arithmetic unit.

As shown in FIG. 1, sliding members 135 are disposed in a space 130 formed in the bottom portion of the inner back surface of the cartridge mounting unit 110. In the embodiment, four sliding members 135 are provided to correspond to the four ink cartridges 30 that can be accommodated in the case 101. The space 130 is in communication with the internal space of the cartridge mounting unit 110. The sliding members 135 can slide within the space 130 in the mounting and removing directions 50. The sliding members 135 have a generally rectangular parallelepiped shape. Each of the sliding members 135 is disposed in the path of the second protrusion 86 provided on the corresponding ink cartridge 30 and contacts this second protrusion 86 when the ink cartridge 30 is inserted into the cartridge mounting unit 110.

A coil spring 139 is provided in the space 130 for each sliding member 135. The coil spring 139 elastically urges the corresponding sliding member 135 toward the opening 112. In other words, the coil spring 139 urges the ink cartridge 30 toward the opening 112 for ejecting the ink cartridge 30 from the cartridge mounting unit 110. When the coil spring 139 is in its natural state, i.e., when no external force is applied to the sliding member 135, the sliding member 135 is in a prescribed position nearer the opening 112. As the ink cartridge 30 is inserted into the cartridge mounting unit 110, the second protrusion 86 of the ink cartridge 30 contacts the sliding member 135 and presses the sliding member 135 toward the back wall of the space 130. Consequently, the sliding member 135 slides to a position closer to the inner back wall of the space 130, compressing the coil spring 139. The compressed coil spring 139 urges the ink cartridge 30 via the sliding member 135 in the removing direction 55.

As shown in FIG. 1, the photosensors 117 are provided at the inner back surface of the case 101 above the sliding members 135. Four of the photosensors 117 are provided to correspond to the four ink cartridges 30 that can be accommodated in the case 101. In other words, the four photosensors 117 are provided to correspond to the four sliding members 135. The photosensors 117 are juxtaposed in the width direction of the case 101 (along the left and right directions 51) in the upper portion of the space 130.

When an ink cartridge 30 is mounted in the case 101, the corresponding sliding member 135 slides toward the inner back surface of the space 130 into the optical path of the photosensor 117 (detection position) and is therefore detected by the photosensor 117. The photosensor 117 has a light-emitting element and light-receiving element similar to the photosensor 114. Therefore, a detailed description of the photosensor 117 will not be repeated. Note that the sliding members 135 and photosensors 117 have been omitted from FIG. 6.

The detection positions of the photosensors 114 in the cartridge mounting unit 110 are upstream in the mounting direction 56 from both the detection positions of the photosensors 116 and photosensors 117.

As shown in FIG. 6, rods 125 are provided on the inner back surface of the case 101. The rods 125 are disposed at a height corresponding to the height of the air valves 73 of corresponding ink cartridges 30 when the ink cartridges 30 are mounted in the cartridge mounting unit 110. Hence, four rods 125 are provided to correspond to the four ink cartridges 30 that can be accommodated in the case 101. The rods 125 are cylindrical in shape and protrude into the opening 112 from the back surface of the case 101 along the mounting and removing directions 50. As an ink cartridge 30 is mounted in the cartridge mounting unit 110, the rod 125 is inserted into the hole 96 formed in the bracket 90 of the ink cartridge 30. When the distal end of the rod 125 contacts the air valve 73, the rod 125 presses against the air valve 73 and opens the air hole 32. The bracket 90 is positioned in the vertical directions 52 by the outer peripheral surface of the rod 125 contacting an inner peripheral surface 98 of the hole 96 formed in the corresponding bracket 90.

As shown in FIG. 6, the engaging members 145 are provided in the case 101 above the opening 112 in the case 101. When an ink cartridge 30 is mounted in the cartridge mounting unit 110, the corresponding engaging member 145 functions to maintain the ink cartridge 30 in its mounted state.

Each engaging member 145 is capable of pivoting about a shaft 147. For example, the shaft 147 is provided through the end of the engaging member 145 nearest the opening 112 and mounted in the case 101. With this construction, the engaging member 145 is supported in the top portion of the case 101 near the opening 112 and is capable of rotating about the shaft 147 toward and away from the opening 112. An engaging part 146 is formed on the end of the engaging member 145 opposite the shaft 147. The engaging part 146 can engage the engaging part 45 of the ink cartridge 30. Through this engagement, the ink cartridge 30 is maintained in its mounted position in the case 101 against the urging force of the sliding member 135. The rotated position of the engaging member 145 when the engaging part 146 can engage with the engaging part 45 will be called the locked position (see FIG. 9), while the rotated position of the engaging member 145 when the engaging part 146 does not engage with the engaging part 45 will be called the unlocked position (see FIG. 8).

The engaging member 145 is urged to rotate downward in the gravitational direction by its own weight or a coil spring (not shown). By moving the front portion 81 of the rotary member 80 upward, the engaging member 145 rotates upward about the shaft 147, shifting from the locked position to the unlocked position. While not illustrated in the drawings, the engaging member 145 is restricted from rotating below the unlocked position.

Operation for Mounting the Ink Cartridges

Figure 7:
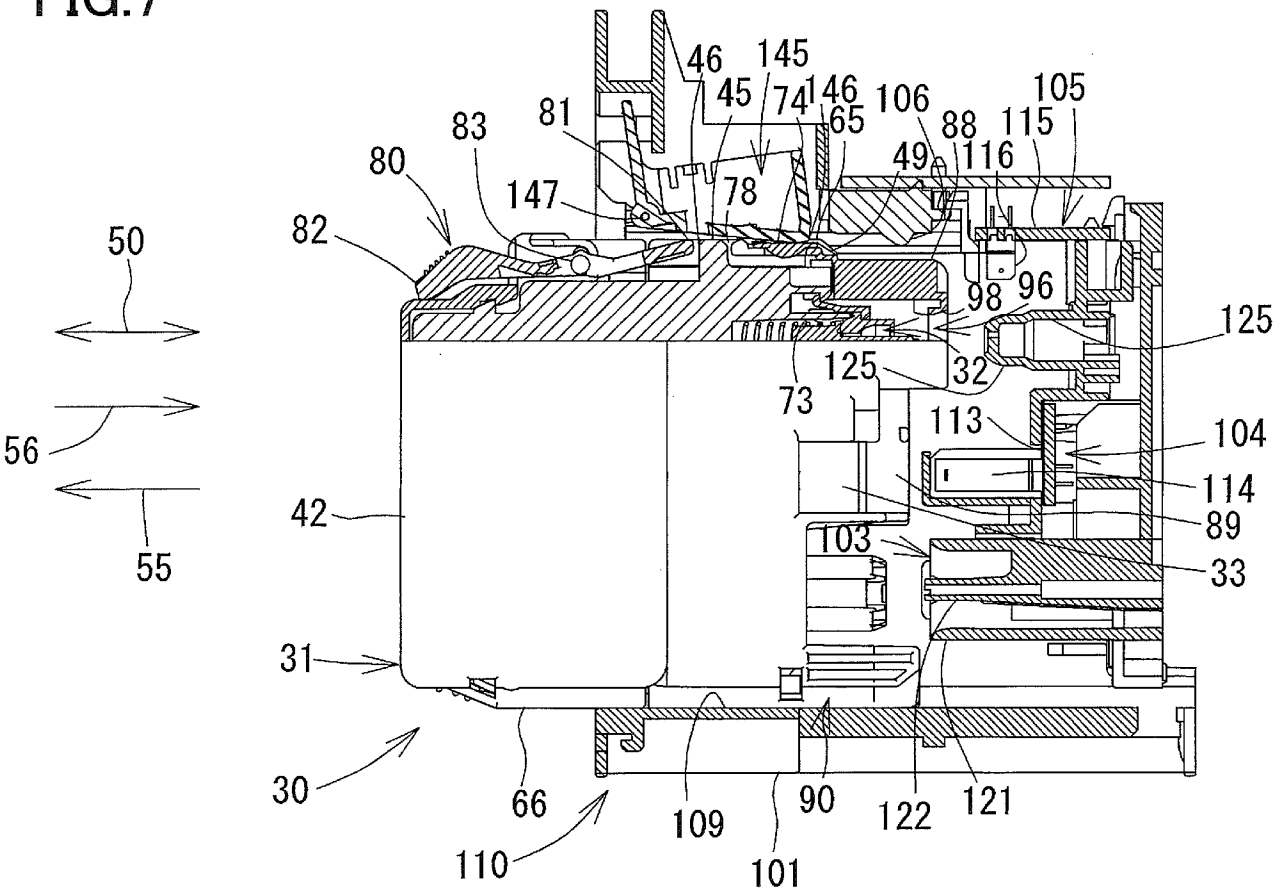
Figure 8:
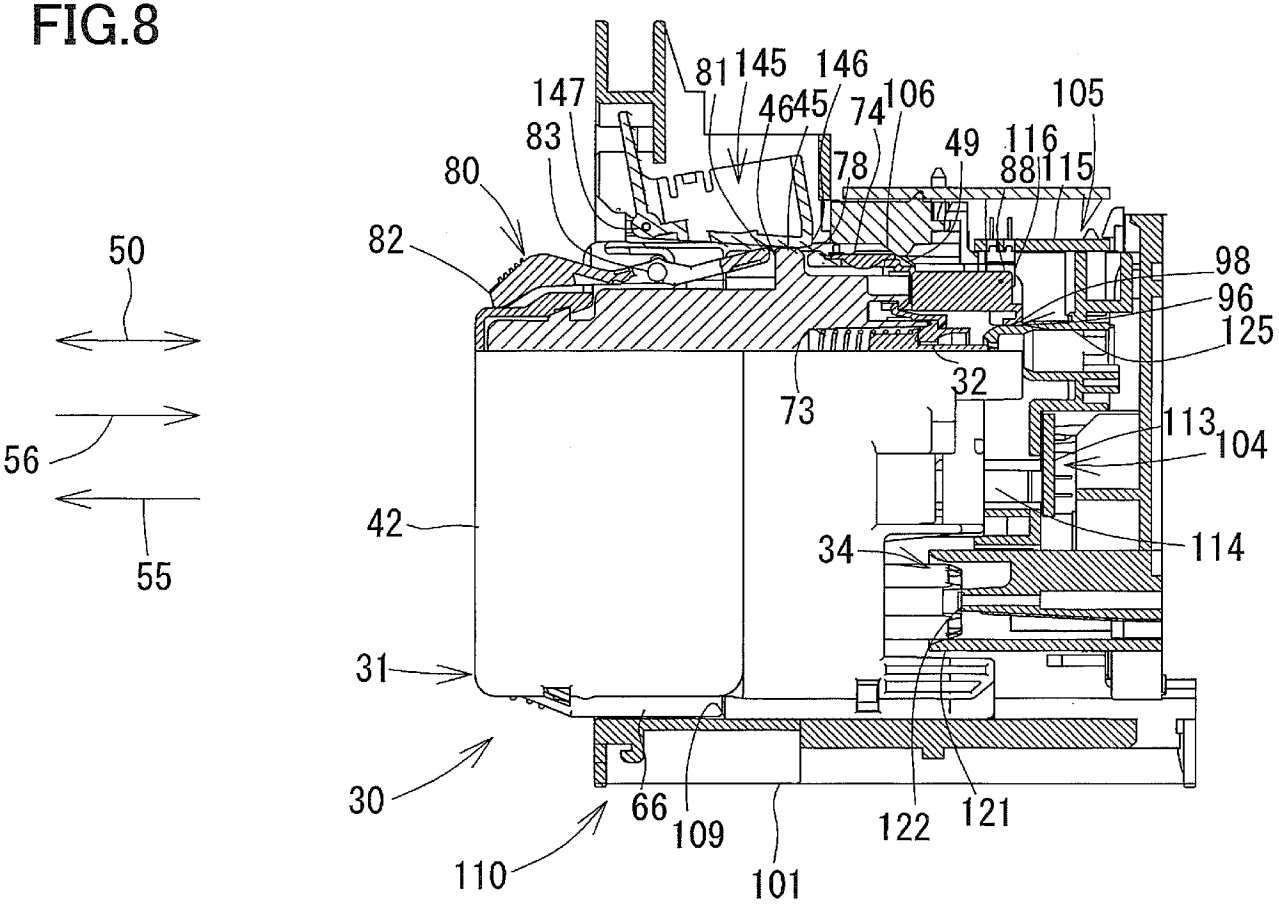

Next, the operation for mounting each of the ink cartridges 30 in the cartridge mounting unit 110 will be described while referring to FIGS. 7 through 9. In FIGS. 7 through 9, the portion of the ink cartridge 30 on the top wall 39 side is shown in cross section.

When preparing to mount the ink cartridge 30 in the cartridge mounting unit 110, the bracket 90 is initially in a state supported on the top wall 39 of the cartridge body 31. In other words, the bracket 90 can be moved upward relative to the cartridge body 31. As shown in FIG. 7, the ink cartridge 30 is then inserted into the cartridge mounting unit 110 along the mounting direction 56. At this time, the guide parts 65 and 66 of the ink cartridge 30 are fitted into the corresponding guide grooves 109 formed in the case 101, positioning the ink cartridge 30 in the left and right directions 51 and the vertical directions 52. With the guide parts 65 and 66 fitted in the guide grooves 109, the ink cartridge 30 can slide rearward toward the inner rear surface of the case 101.

As the ink cartridge 30 is inserted into the case 101, the distal end of the first protrusion 85 (see FIG. 4) contacts the engaging part 146 of the engaging member 145. As the ink cartridge 30 is inserted further toward the inner back surface of the case 101, the engaging part 146 of the engaging member 145 slides over the sloped member 49 formed on the front wall 40 side of the IC chip 74, causing the engaging member 145 to rotate counterclockwise in FIG. 7 from the locked position into the unlocked position. As the ink cartridge 30 is inserted further, the engaging member 145 slides in sequence over the tops of the sloped member 49, IC chip 74, and recess 78.

As the ink cartridge 30 inserted further, the detection target 89 passes through the detection position of the photosensor 114. At this time, the sensing unit 33 has not yet arrived at the detection position of the photosensor 114. When the photosensor 114 detects the detection target 89, the signal outputted from the photosensor 114 changes from high level to low level. As the ink cartridge 30 is further inserted toward the back surface of the case 101, the detection target 89 leaves the detection position of the photosensor 114, causing the signal outputted from the photosensor 114 to change back to high level, since a gap is present between the detection target 89 and sensing unit 33. Hence, the output signal of the photosensor 114 changes from high level to low level and back to high level before the sensing unit 33 arrives at the detection position of the photosensor 114.

As the ink cartridge 30 is further inserted, the plate 88 of the first protrusion 85 reaches the detection position of the photosensor 116, as illustrated in FIG. 8. When the photosensor 116 detects the plate 88, the signal outputted from the photosensor 116 changes from high level to low level.

During the process of mounting the ink cartridge 30 into the cartridge mounting unit 110, the second protrusion 86 of the ink cartridge 30 also contacts the sliding member 135 (see FIG. 1). As the ink cartridge 30 is inserted further into the cartridge mounting unit 110, the second protrusion 86 pushes the sliding member 135 toward the back wall of the space 130 against the urging force of the coil spring 139. Accordingly, the photosensor 117 detects the sliding member 135.

Further, the ink delivery unit 34 of the ink cartridge 30 comes into contact with the retaining part 121, at which time the ink needle 122 is inserted into the ink delivery port 71 of the ink delivery unit 34. As the ink cartridge 30 moves further in the mounting direction 56, the ink needle 122 inserted into the ink delivery port 71 contacts and pushes the ink valve 70, forcing the ink valve 70 away from the ink delivery port 71. Hence, by inserting the ink delivery unit 34 into the retaining part 121 so that the ink needle 122 is inserted into the ink delivery port 71, the cartridge body 31 of the ink cartridge 30 is mounted in a prescribed position relative to the case 101. While not shown in the drawings, an ink inlet is formed in the distal end of the ink needle 122. Ink in the ink chamber 36 can flow into the ink needle 122 through this ink inlet.

After the ink needle 122 is inserted into the ink delivery port 71, the rod 125 of the case 101 is inserted through the hole 96 formed in the bracket 90, as shown in FIG. 8. The bracket 90 can move relative to the cartridge body 31 in the vertical directions 52. Thus, when the rod 125 is inserted into the hole 96, the outer peripheral surface of the rod 125 contacts the upper portion of the inner peripheral surface 98 in the hole 96, forcing the bracket 90 to slide upward to a predetermined position. Consequently, this configuration can position the bracket 90 in the vertical directions 52 from the bottom. In other words, this configuration can position the bracket 90 in the vertical directions 52 by restricting the bracket 90 from moving downward from the predetermined position in the vertical directions 52.

In the meantime, the contacts 106 come into contact with the sloped member 49 of the bracket 90. Since the sloped member 49 slopes upward in the removing direction 55 and the bracket 90 is fixed in position from the bottom relative to the vertical directions 52 by the rod 125, the contacts 106 are guided along the sloped member 49 and are elastically deformed upward. Hence, once the contacts 106 slide over the sloped member 49 and arrive on the IC chip 74, the bracket 90 will be pinched between the contacts 106 and rod 125 and fixed in position relative to the vertical directions 52 from both the top and bottom. In other words, the bracket 90 is fixed in position in the vertical directions 52 by being restricted from moving both downward and upward in the vertical directions 52.

When the ink cartridge 30 is inserted all the way to the inner back surface of the case 101, as illustrated in FIG. 9, the contacts 106 contact and form an electrical connection with the "hot" electrode 75, ground electrode 76, and signal electrode 77 of the IC chip 74.

Further, as the ink cartridge 30 arrives in its mounted position shown in FIG. 9, the distal end of the rod 125 contacts and pushes the air valve 73 away from the air hole 32. Consequently, external air can enter the ink chamber 36 through the air hole 32.

Further, once the ink cartridge 30 has arrived in its mounted position shown in FIG. 9, the engaging surface 46 on the engaging part 45 of the cartridge body 31 has passed the engaging part 146 of the engaging member 145 in the mounting direction 56. Accordingly, the engaging member 145 rotates clockwise in FIG. 9 and is positioned in the engaging part 45 with the engaging part 146 contacting the engaging surface 46. Hence, with the engaging member 145 engaged in the engaging part 45, the ink cartridge 30 is maintained in its mounted position, resisting the urging force of the coil spring 139 or the like. This completes the operation to mount the ink cartridge 30 in the cartridge mounting unit 110.

When the ink cartridge 30 is mounted in the cartridge mounting unit 110, the front portion 81 of the rotary member 80 is positioned beneath the engaging part 146 of the engaging member 145. The rear portion 82 of the rotary member 80 is separated from the bottom surface of the engaging part 45 and positioned above the top wall 39 of the cartridge body 31.

Further, when the ink cartridge 30 arrives in its mounted position, the plate 88 of the first protrusion 85, the sensing unit 33, and the sliding member 135 have all advanced to the respective detection positions of the corresponding photosensors 114, 116, and 117. At this time, each of the photosensors 114, 116, and 117 outputs a low level signal, provided that the indicator 62 is in its lowermost position. The signals outputted from the photosensors 114, 116, and 117 and data read from the IC chip 74 are used to determine the type of ink cartridge 30 (ink color, capacity, etc.) and the amount of remaining ink. Since any of various conventional methods may be used to determine the type of ink cartridge 30 and amount of residual ink, a description of these methods will not be given here.

When the ink in the ink chamber 36 of the ink cartridge 30 is consumed, the spent ink cartridge 30 is removed from the cartridge mounting unit 110 and a new ink cartridge 30 is mounted in its place.

When removing the ink cartridge 30 from the cartridge mounting unit 110, the operator presses down on the rear portion 82 of the rotary member 80, causing the front portion 81 of the rotary member 80 to move upward away from the bottom surface of the engaging part 45. By moving upward, the front portion 81 of the rotary member 80 pushes the engaging member 145 upward. The engaging member 145 continues to rotate until the engaging part 146 of the engaging member 145 is above the engaging surface 46, i.e., until the engaging part 146 separates from the engaging surface 46. In other words, the engaging member 145 rotates from the locked position to the unlocked position and releases the ink cartridge 30.

When the engaging part 146 of the engaging member 145 separates from the engaging surface 46, an external force applied to the cartridge body 31, such as the urging force of the coil spring 139, attempts to move the cartridge body 31 in the removing direction 55. However, since the operator is currently pressing down on the rotary member 80, the operator's hand absorbs the urging force of the coil spring 139 or the like through the rotary member 80. Further, in the process of removing the ink cartridge 30 in the removing direction 55, the IC chip 74 on top of the bracket 90 is released from the downward urging force applied by the contacts 106 of the cartridge mounting unit 110. Further, when the outer peripheral surface of the rod 125 disengages from the inner peripheral surface 98 of the hole 96, the bracket 90, which had been raised above the cartridge body 31, can move downward by its own weight. At this time, the operator can pull the cartridge body 31 in the removing direction 55 to remove the ink cartridge 30 from the cartridge mounting unit 110.

In its initial state, the bracket 90 is in a state supported on the top wall 39 of the cartridge body 31. However, the bracket 90 may not be initially supported on the top wall 39 of the cartridge body 31. That is, the bracket 90 may be initially in a state that the bracket 90 is able to move downward relative to the cartridge body 31, as follows. That is, in the initial state, the bracket 90 is supported by static friction between the edge portions 67 and 68 of the bracket 90 and the sloped surfaces 47 and 48 of the cartridge body 31. When the ink cartridge 30 is inserted into the case 101, initially the rod 125 is not in contact with the inner peripheral surface 98 formed in the hole 96 of the bracket 90, but as the ink cartridge 30 is further inserted, the contacts 106 contact the sloped member 49, pushing the bracket 90 downwardly, and the upper portion of the inner peripheral surface 98 in the hole 96 contacts the outer peripheral surface of the rod 125, fixing the position of the bracket 90 with respect to the vertical directions 52 from the bottom. In other words, the bracket 90 is fixed in position in the vertical directions 52 by being restricted from moving downward in the vertical directions 52.

Release Unit

A release unit 150 is mounted on each ink cartridge 30 while the ink cartridge 30 is in storage or in transit until the ink cartridge 30 is mounted in the cartridge mounting unit 110. Next, the release unit 150 will be described in detail while referring to FIGS. 12 through 14B.

The release unit 150 is made of resin. As shown in FIGS. 12 through 14B, the release unit 150 includes a main body 151 and an operating lever 152. The operating lever 152 is movable relative to the main body 151. The main body 151 is generally box-shaped and open on one side. The main body 151 includes a front wall 153, a top wall 154, a bottom wall 155, and side walls 156 and 157, which are integrated with one another. The front wall 153 constitutes the side opposite the front wall 140 of the bracket 90 when the release unit 150 is mounted on the ink cartridge 30. The top wall 154, bottom wall 155, and side walls 156 and 157 are all connected to the front wall 153 and are arranged orthogonal to the same. The opening in the main body 151 is formed on the side opposite the front wall 153. The front wall 153 has substantially the same width (dimension in the left and right directions 51) as the front wall 140 of the bracket 90 and has a slightly smaller dimension than the front wall 140 of the bracket 90 in the vertical directions 52. The dimensions of the top wall 154, bottom wall 155, and side walls 156 and 157 in the front and rear directions 53 are shorter than the dimension of the ink cartridge 30 in the same directions.

A hook 158 is provided on the bottom wall 155 side of the main body 151. A hook 159 is provided on the top wall 154 side of the main body 151. A hook 162 is provided between the hooks 158 and 159. The hooks 158, 162, and 159 are aligned in the vertical directions 52 when the release unit 150 is mounted on the ink cartridge 30. The hooks 158, 159, and 162 are integrally formed with the main body 151.

More specifically, the hook 158 extends along the bottom wall 155 in a direction away from the front wall 153. The hook 158 is plate-shaped with a hook-like distal end for engaging with the outer peripheral surface of the ink delivery unit 34 on the ink cartridge body 31. The hook 158 can deform elastically in a direction away from the bottom wall 155, i.e., toward the outside of the bottom wall 155. The hook 158 protrudes out of the opening formed in the main body 151 a distance sufficient for the distal end of the hook 158 to contact the outer peripheral surface of the ink delivery unit 34 when the release unit 150 is mounted on the ink cartridge 30.

The hook 159 extends from the top wall 154 side of the front wall 153 in a direction away from the front wall 153. The hook 159 has a cylindrical shape. Slits formed in the hook 159 along the axial direction of the cylindrical shape divide the hook 159 into a pair of peripheral wall parts 160 and 161 (see FIGS. 12 and 13B) that confront each other in the left and right directions 51. The distal ends of the peripheral wall parts 160 and 161 are formed in hook-like shapes. The peripheral wall parts 160 and 161 can be elastically deformed toward the inside of the hook 159. The hook 159 is inserted into the hole 96 of the bracket 90 when the release unit 150 is mounted on the ink cartridge 30, and the hook-shaped peripheral wall parts 160 and 161 can engage with the inner peripheral surface 98 in the hole 96. The hook 159 protrudes from the opening formed in the main body 151 a distance sufficient for the distal end of the hook 159 to contact the inner peripheral surface 98 in the hole 96 when the release unit 150 is mounted on the ink cartridge 30.

The hook 162 is supported in the internal space of the box-shaped main body 151 so as to be pivotable about an axis extending in the left and right directions 51.

More specifically, the hook 162 is positioned between the pair of side walls 156 and 157, and is spaced apart from the side walls 156 and 157. The hook 162 is connected to the side walls 156 and 157 via a pair of beams 169. Thus, the hook 162 is supported by the side walls 156 and 157 via the pair of beams 169. The beams 169 are integrated with the hook 162 and the side walls 156 and 157. The beams 169 are square bars whose central axes extend orthogonal to the side walls 156 and 157. In other words, the central axes of the beams 169 extend in the left and right directions 51. The central axes of the beams 159 are aligned with each other in the left and right directions 51. Because the beams 159 are made of resin and are integrated with the hook 162 and the side walls 156 and 157, the beams 159 can elastically twist about their central axes. The central axes of the beams 159 serve as the axis about which the hook 162 pivots.

The hook 162 includes: a pivoting center body 170; a plate-shaped contact part 171; and a hook part 172, which are integrated with one another.

The pivoting center body 170 is a polygonal column whose central axis extends orthogonal to the central axes of the beams 169. The pivoting center body 170 has a pair of opposite side surfaces that confront the side walls 156 and 157 and another pair of opposite side surfaces that confront the hooks 158 and 159. The pair of beams 159 are connected to the pair of opposite side surfaces of the pivoting center body 170 that confront the side walls 156 and 157.

The plate-shaped contact part 171 protrudes from the side surface of the pivoting center body 170 confronting the hook 159. The plate-shaped contact part 171 is a rectangular plate extending parallel with the side walls 156 and 157. A slit-shaped opening 159*a* is formed in the cylindrically-shaped hook 159 at a position confronting the hook 162. The slit-shaped opening 159*a* extends along the axial direction of the cylindrically-shaped hook 159. The plate-shaped contact part 171 of the hook 162 passes through the slit-shaped opening 159*a* and protrudes into the inside of the hook 159.

The hook part 172 is connected to the side surface of the pivoting center body 170 confronting the hook 158. The hook part 172 is formed in a general hook-like shape and extends in a direction away from the front wall 153. The hook part 172 extends out through the opening in the main body 151. The distal end 174 of the hook part 172 is divided in the left and right directions 51 into a pair of hook-shaped parts. These hook-shaped parts can respectively engage the protruding parts 93 and 94 provided on the detection target 89 of the bracket 90. A hole 167 is formed in the front wall 153. An end of the hook part 172 opposite the pair of hook-shaped parts 174 (which will be called "front side end 173", hereinafter) projects through the hole 167 to the outer side of the front wall 153.

Figure 13A:
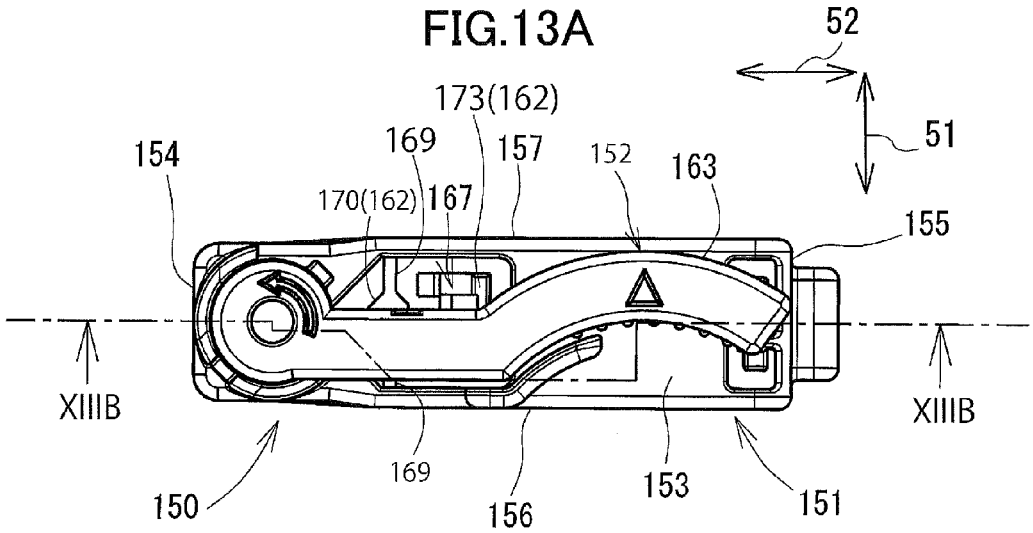
FIG. 13A is a front view of the release unit shown in FIG. 12 when a lever part of an operating lever is positioned over a front wall of the ink cartridge.
Figure 13B:
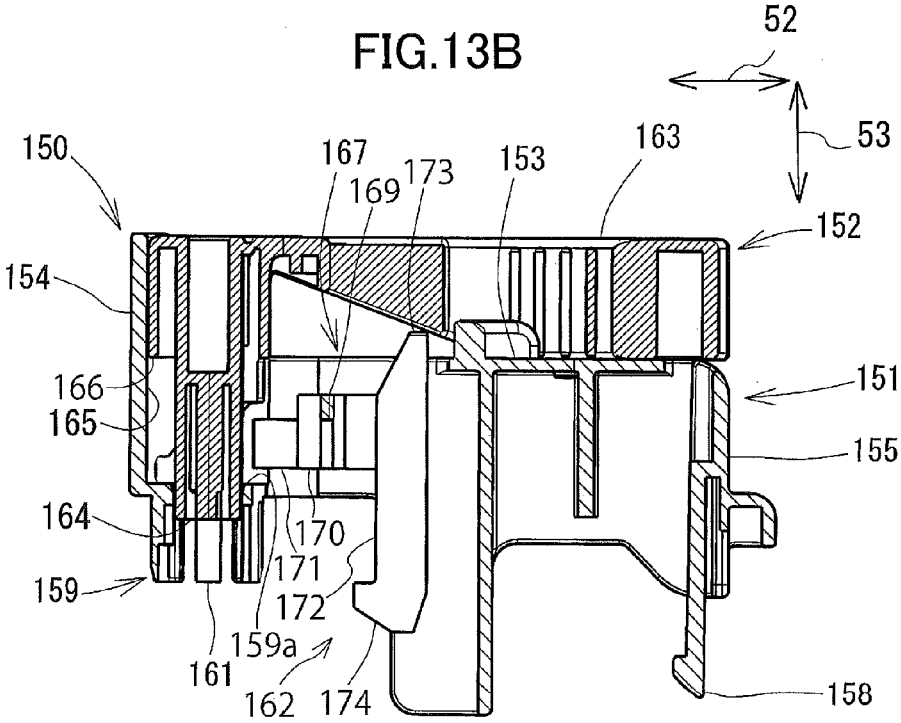
FIG. 13B is a cross-sectional view of the release unit taken along a line XIIIB-XIIIB in FIG. 13A.

When the hook 162 is in its natural state, i.e., no external force is applied to the hook 162, the hook 162 is held in a position with the hook-shaped parts on the distal end 174 engaged with the protruding parts 93 and 94 (the state shown in FIGS. 13A and 13B). When the plate-shaped contact part 171 is contacted with a contact part 166 (to be described later) as shown in FIG. 14B, the hook 162 pivots about the central axes of the beams 169 in the counterclockwise direction in the drawing of FIG. 14B, while causing the beams 169 to elastically twist in the counterclockwise direction. Thus, the hook 162 pivots in a direction to move the distal end 174 away from the hook 159. As a result, the hook-shaped parts on the distal end 174 are disengaged from the protruding parts 93 and 94.

The operating lever 152 is provided on the front wall 153 side of the main body 151. The operating lever 152 includes a lever part 163 and a release part 164 which are integrated with each other. The lever part 163 has a flat plate shape that is curved in an arc shape at its distal end. The release part 164 is columnar in shape and protrudes from the proximal end of the lever part 163, i.e., the end that is not curved. A hole 165 is formed in the front wall 153 of the main body 151 that communicates with the interior space of the hook 159. By inserting the release part 164 into the hole 165, the release part 164 is fitted into the cylindrically-shaped hook 159. While not shown in the drawings, a groove is formed in the inner peripheral surface of the hook 159, extending in a spiral shape along the axial direction thereof, and bosses provided on the outer peripheral surface of the release part 164 are configured to engage in this groove. Hence, the release part 164 can move along the front and rear directions 53 relative to the hook 159 when rotated inside the hook 159.

Figure 14A:
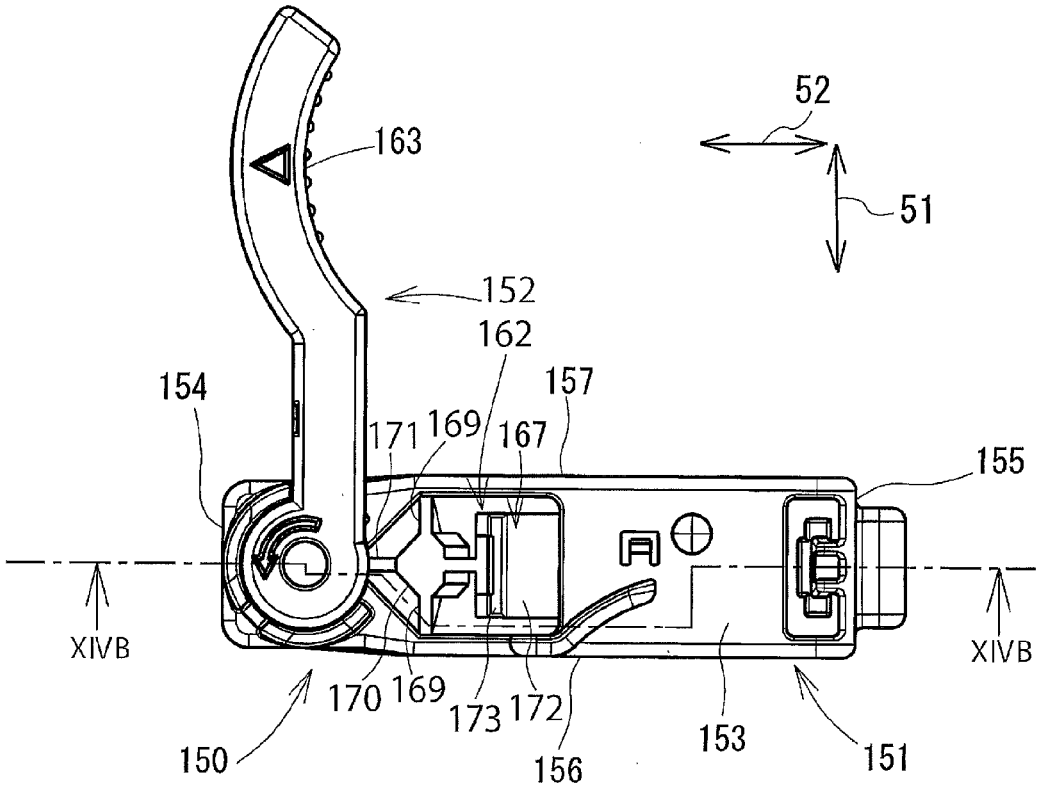
FIG. 14A is a front view of the release unit when the operating lever is rotated 90 degrees from the state shown in FIG. 13A.
Figure 14B:
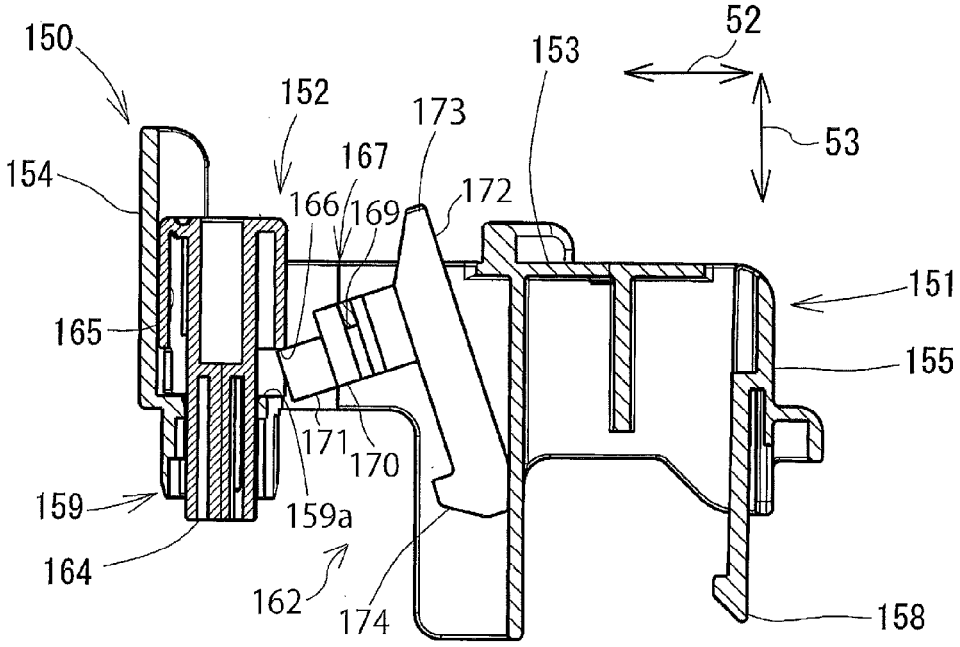
FIG. 14B is a cross-sectional view of the release unit taken along a line XIVB-XIVB in FIG. 14A.

The operating lever 152 can rotate about the central axis of the cylindrically-shaped hook 159 between the position shown in FIGS. 13A and 13B and the position shown in FIGS. 14A and 14B. When the lever part 163 is positioned over the front wall 153 of the main body 151 (the position shown in FIGS. 13A and 13B), the release part 164 is accommodated in the internal space of the hook 159. When the operating lever 152 is rotated relative to the main body 151, the operating lever 152 moves relative to the main body 151 also in the front and rear directions 53. So, by rotating the operating lever 152 relative to the main body 151 approximately 90 degrees until the lever part 163 protrudes farthest from the front wall 153 of the main body 151 as shown in FIGS. 14A and 14B, a portion of the release part 164 protrudes out from the distal end of the hook 157. The contact part 166 is formed on the outer peripheral surface of the release part 164. The contact part 166 contacts the plate-shaped contact part 171 of the hook 162, which protrudes into the inside of the hook 159 through the slit-shaped opening 159*a*. As a result, the distal end 174 of the hook 162 pivots away from the hook 159, while the beams 159 elastically twist about their central axes.

Figure 15:
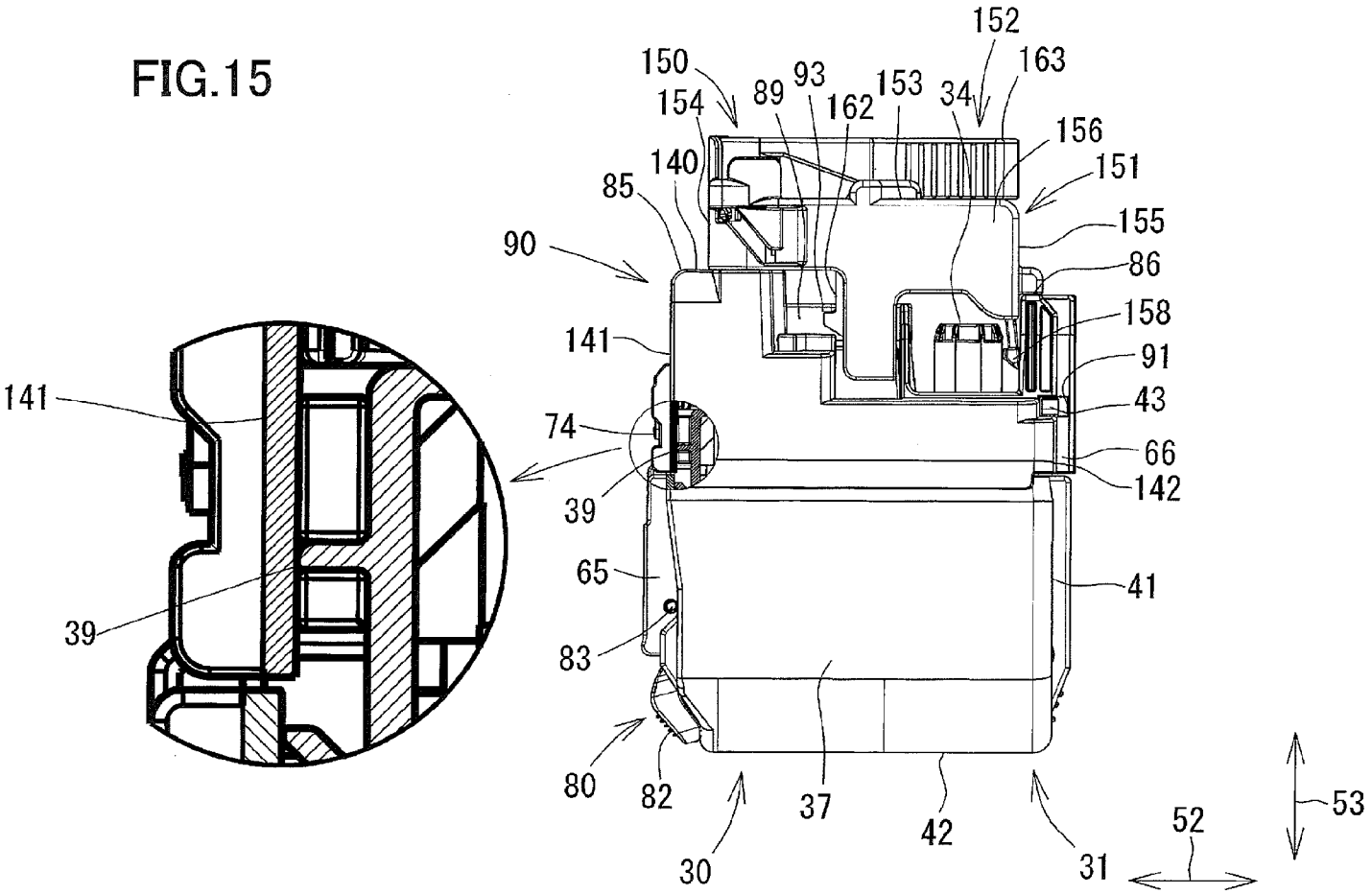
FIG. 15 is a side view of the ink cartridge on which the release unit is mounted.

As shown in FIG. 15, the release unit 150 can be mounted on the ink delivery unit 34 side of the ink cartridge 30. In this state, the hook 158 is engaged with the outer peripheral surface of the ink delivery unit 34 formed in the cartridge body 31, the hook 159 is engaged with the inner peripheral surface 98 of the hole 96 formed in the bracket 90, and the hook 162 is engaged with the protruding parts 93 and 94 of the detection target 89 formed in the bracket 90. When the release unit 150 is mounted on the ink cartridge 30, the operating lever 152 is positioned such that the lever part 163 is contained within the front wall 153 of the main body 151 (i.e., the lever part 163 does not protrude off the edges of the front wall 153). Further, through contact with the outer peripheral surface of the ink delivery unit 34, the hook 158 is elastically deformed outward from the bottom wall 155. The restoring force of the elastically deformed hook 158 urges the cartridge body 31 of the ink cartridge 30 toward the top wall 154 side of the release unit 150. On the other hand, the hook 159 is engaged in the hole 96 of the bracket 90. So, the hook 159 through the urging force of the hook 158 urges the bracket 90 in a direction for bringing the hole 96 closer to the ink delivery unit 34. Consequently, the bracket 90 shifts downward (rightward in FIG. 15) relative to the cartridge body 31 until the top wall 141 of the bracket 90 contacts the top wall 39 of the cartridge body 31.

Figure 16:
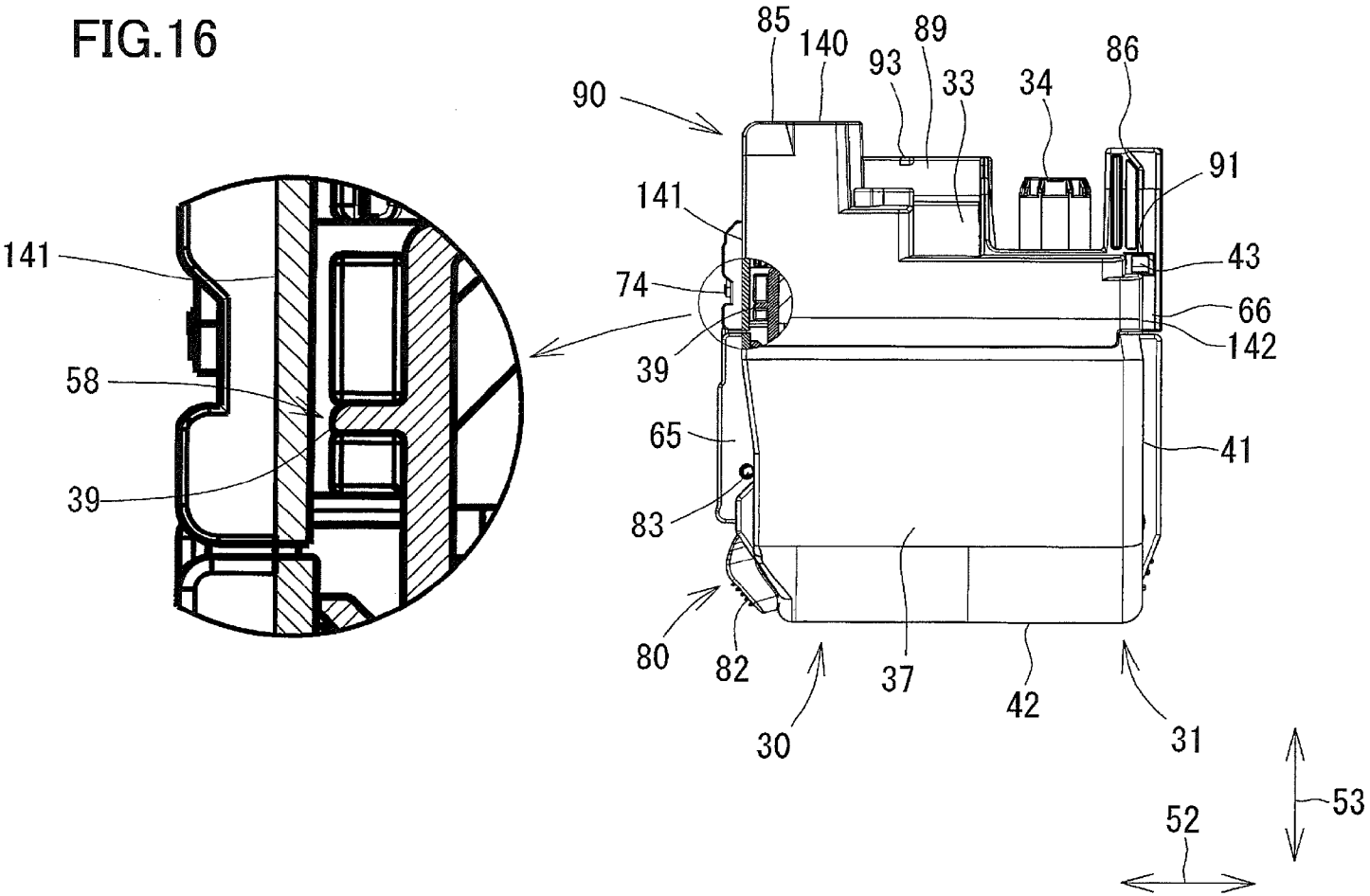
FIG. 16 is a side view of the ink cartridge from which the release unit is detached.

As shown in FIG. 16, the release unit 150 must be removed before using the ink cartridge 30. As described above, the operator holds the lever part 163 of the operating lever 152 and rotates the operating lever 152 approximately 90 degrees to move the operating lever 152 relative to the hook 159 in the front and rear directions 53. Through this operation, a portion of the release part 164 protrudes out from the distal end of the hook 159, and the contact part 166 formed on the outer peripheral surface of the release part 164 contacts the plate-shaped contact part 171 of the hook 162. Consequently, the hook 162 rotates about the central axes of the beams 159 in a direction to separate the distal end 174 of the hook 162 away from the hook 159.

Further, by moving relative to the hook 159, the release part 164 protrudes out from the hook 159. That is, the release part 164 moves in a direction toward the air valve 73 of the ink cartridge 30 in the front and rear directions 53. The release part 164 contacts the air valve 73, and pushes the air valve 73 against an urging force of a coil spring, which is provided in the cartridge body 31 to urge the air valve 73 in a direction to close the air hole 32. This operation opens the air hole 32 that was previously sealed by the air valve 73, allowing external air to enter the ink chamber 36. Accordingly, the airspace in the ink chamber 36, which was previously maintained at a negative pressure, is equalized to atmospheric pressure. The release part 164 also receives a reaction force from the air valve 73 that moves the main body 151 of the release unit 150 away from the bracket 90, thereby disengaging the hook 159 of the release unit 150 from the inner peripheral surface 98 of the bracket 90.

When the hook 162 of the release unit 150 rotates, the hook 162 also disengages from the protruding parts 93 and 94 on the bracket 90. Consequently, the release unit 150 rotates away from the bracket 90 about an axis in the area of engagement between the hook 158 and ink delivery unit 34 and is detached from the ink cartridge 30. By removing the release unit 150 from the ink cartridge 30, the bracket 90 can once again move relative to the cartridge body 31. Hence, the top wall 141 of the bracket 90 can move away from the top wall 39 of the cartridge body 31, forming a gap 58 between the top wall 141 and top wall 39, as shown in FIG. 16.

As described above, the ink cartridge 30 includes: the cartridge body 31; the bracket 90; the IC chip 74 provided on the bracket 90; and the release unit 150 that can be mounted on the cartridge body 31 and bracket 90. The cartridge body 31 has the ink delivery unit 34 provided on the front wall 40. The bracket 90 has the front wall 140 that confronts the front wall 40 of the cartridge body 31, and the top wall 141 that extends continuously from the front wall 140 in the front and rear directions 53. The bracket 90 is capable of moving relative to the cartridge body 31 in the vertical directions 52 for contacting and separating the top wall 141 to and from the cartridge body 31. The release unit 150 restricts relative movement between the cartridge body 31 and bracket 90, with the top wall 141 of the bracket 90 in contact with the cartridge body 31.

The concept of the restricting function performed by the release unit 150 is simply that the force required for moving the bracket 90 relative to the cartridge body 31 is greater when the release unit 150 is mounted on the ink cartridge 30 than when the release unit 150 is not mounted on the ink cartridge 30. In other words, the release unit 150 need not firmly fix the bracket 90 so that the bracket 90 cannot move at all relative to the cartridge body 31.

The release unit 150 restricts relative movement between the cartridge body 31 and bracket 90 while the top wall 141 of the bracket 90 remains in contact with the cartridge body 31. Accordingly, a gap is not formed between the top wall 141 of the bracket 90 and the cartridge body 31 when the release unit 150 is mounted on the ink cartridge 30. This construction prevents deformation of the top wall 141 caused by a force applied to the bracket 90 in a direction for pressing the top wall 141 against the cartridge body 31.

Operational Advantages of the Embodiment

By mounting the release unit 150 on the ink cartridge 30, as described above, the bracket 90 is restricted from moving relative to the cartridge body 31, with the top wall 141 of the bracket 90 maintained in contact with the top wall 39 of the cartridge body 31. If the ink cartridge 30 is vacuum-packed, for example, the packaging is shrunk tightly around the ink cartridge 30, applying a force to the bracket 90 that acts to push the bracket 90 inward. However, with the release unit 150 mounted on the ink cartridge 30, the top wall 141 of the bracket 90 is maintained in contact with the top wall 39 of the cartridge body 31. Accordingly, the cartridge body 31 reinforces the bracket 90 from the inside of the top wall 141, reducing the likelihood of the bracket 90 bending inward.

Further, the hooks 158 and 159 of the release unit 150 are aligned in the same direction that the bracket 90 moves relative to the cartridge body 31. Therefore, the top wall 141 of the bracket 90 can be easily maintained in contact with the top wall 39 of the cartridge body 31.

Further, since the hook 158 is elastically deformable, the restoring force of the hook 158 when the release unit 150 is mounted on the ink cartridge 30 urges the bracket 90 in a direction for placing the top wall 141 in contact with the top wall 39 of the cartridge body 31. Hence, no matter what position the bracket 90 is in relative to the cartridge body 31, when the release unit 150 is mounted on the ink cartridge 30, the bracket 90 is moved relative to the cartridge body 31 until the top wall 141 contacts the top wall 39.

When the release unit 150 is removed from the ink cartridge 30, the release part 164 pushes the air valve 73 to open the air hole 32. Accordingly, the airspace in the ink chamber 36 is neutralized to atmospheric pressure prior to mounting the ink cartridge 30 in the cartridge mounting unit 110.

Further, when the release unit 150 is mounted on the ink cartridge 30, the peripheral wall parts 160 and 161 of the hook 159 are engaged with the inner peripheral surface 98 of the hole 96 formed in the bracket 90. The peripheral wall parts 160 and 161 are aligned in a direction intersecting the direction of relative movement between the cartridge body 31 and bracket 90. Accordingly, the peripheral wall parts 160 and 161 can engage the inner peripheral surface 98 with a uniform force regardless the positional relationship of the bracket 90 and cartridge body 31.

Further, the bracket 90 can move relative to the cartridge body 31 of the ink cartridge 30. However, when the ink cartridge 30 is mounted in the cartridge mounting unit 110, the retaining part 121 and ink needle 122 formed in the case 101 fix the position of the cartridge body 31 relative to the vertical directions 52, while the rod 125 and contacts 106 fix the position of the bracket 90 relative to the vertical directions 52.

Since the ink cartridge 30 is configured of a plurality of assembled members, the manufacturing tolerance for each member is low, leading to potential problems in design and manufacturing. Even when sufficient tolerance specifications are established for each component, there is a danger that the ink needle 122 will collide with the distal endface of the ink delivery unit 34 rather than enter the same or that the contacts 106 will contact the IC chip 74 with excessive pressure, causing damage to the ink needle 122 or contacts 106. However, since the ink delivery unit 34 provided on the cartridge body 31 and the IC chip 74, plate 88, and detection target 89 provided on the bracket 90 are positioned independently from each other during the mounting process in the embodiment, the ink delivery unit 34 and the IC chip 74, plate 88, and detection target 89 can independently access the ink needle 122 and the contacts 106 and photosensors 114 and 116. So, the probability of such damage is reduced.

Variations Of The Embodiment

Figure 17:
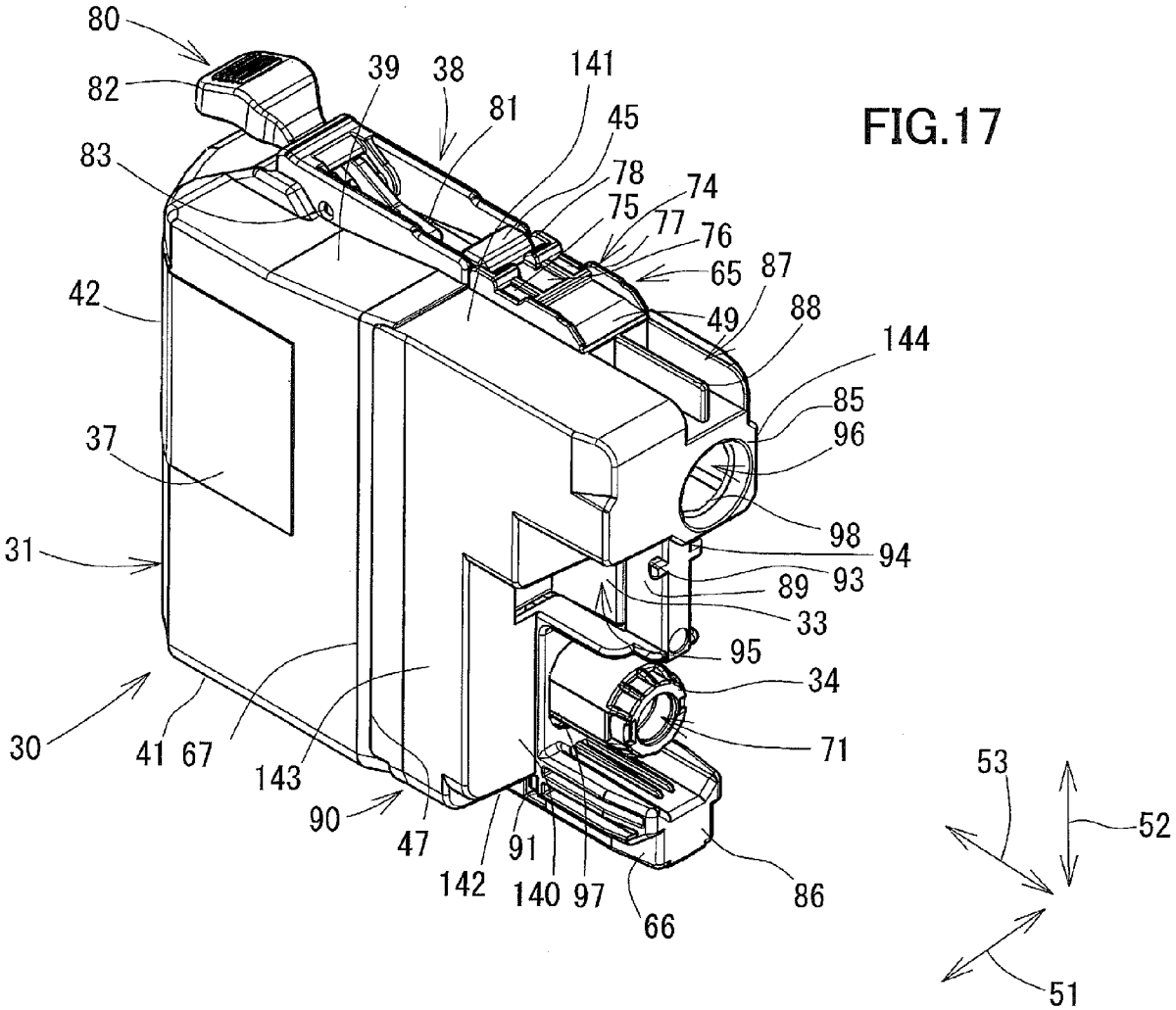
FIG. 17 is a perspective view showing an external appearance of an ink cartridge according to still another modification.

In the embodiment described above, the guide parts 65 and 66 are disposed in substantially the center region of the ink cartridge 30 with respect to the left and right directions 51. However, the printing fluid cartridge according to the present invention may be implemented with an ink cartridge 30 similar to that shown in FIG. 17. According to this variation, the dimension of the ink cartridge 30 in the left and right directions 51 is increased in order to increase the capacity of the ink chamber 36, and the guide parts 65 and 66 are offset from the center of the ink cartridge 30 with respect to the left and right directions 51. In this wider version of the ink cartridge 30, the top wall 141 of the bracket 90 is more susceptible to deformation when subjected to an external force since the dimension, on the top wall 141, from the edge formed at the side wall 143 to the guide part 65 is greater. However, the release unit 150 mounted on the ink cartridge 30 maintains the top wall 141 of the bracket 90 in contact with the top wall 39 of the cartridge body 31, restricting relative movement between the cartridge body 31 and bracket 90, and the cartridge body 31 reinforces the top wall 141 of the bracket 90 from the inside thereof. Accordingly, the bracket 90 is less likely to deform by bending inward when an external force is applied to the outside of the bracket 90.

In the embodiment, the IC chip 74, plate 88, detection target 89, and other accessible parts are provided in the ink cartridge 30. However, rather than a plurality of such accessible parts, it is sufficient to provide the IC chip 74 on the ink cartridge 30 as the only accessible part.

In the embodiment, the release unit 150 has the release part 164 that pushes against the air valve 73 to open the air hole 32 when the release unit 150 is removed. However, the restriction member according to the present invention may be implemented by a structure that does not include the release part 164.

In the embodiment, the peripheral wall parts 160 and 161 of the release unit 150 engage with the inner peripheral surface 98 of the hole 96 formed in the bracket 90. However, the release unit 150 may be mounted on the ink cartridge 30 through an engagement with other parts on the ink cartridge 30.

While the invention has been described in detail with reference to the embodiment and variations thereof, it would be apparent to those skilled in the art that various changes and modifications may be made therein without departing from the spirit of the invention.

What is claimed is:

1. A printing fluid cartridge, comprising:

a cartridge body having a printing fluid delivery unit provided on a first cartridge-body surface, the printing fluid delivery unit extending in a first direction;

a bracket having at least a first bracket wall that confronts the first cartridge-body surface of the cartridge body, and a second bracket wall extending continuously from the first bracket wall in the first direction, the bracket being capable of moving relative to the cartridge body in a second direction along which the second bracket wall contacts and separates from the cartridge body, the second direction intersecting the first direction; and a restriction member that is configured to be detachably mounted on the cartridge body and the bracket, the restriction member being configured to, when the restriction member is mounted on the cartridge body and the bracket, restrict relative movement between the cartridge body and the bracket in the second direction and maintain contact between the second bracket wall of the bracket and the cartridge body, wherein an electrical interface is provided on the second bracket wall of the bracket, and wherein the restriction member includes a hook configured to urge the cartridge body in a direction toward the electrical interface, thereby restricting relative movement between the cartridge body and the bracket in the second direction.

2. The printing fluid cartridge according to claim 1, wherein the hook is configured to engage with the cartridge body, and wherein the restriction member further includes:

an engaging part configured to engage with the bracket, wherein the hook and the engaging part are configured so as to be engaged with the cartridge body and the bracket, respectively, while being aligned in the second direction.

3. The printing fluid cartridge according to claim 2, wherein the hook is elastically deformable and urges the cartridge body in a direction for placing the second bracket wall in contact with the cartridge body when the restriction member is mounted on the cartridge body and the bracket.

4. The printing fluid cartridge according to claim 2, wherein the cartridge body has an air communicating part provided on the first cartridge-body surface, the bracket is formed with a first opening allowing the printing fluid delivery unit to protrude outwardly and a second opening exposing the air communicating part outwardly, the first opening and the second opening being positioned on the first bracket wall, the hook is engaged with the printing fluid delivery unit on the cartridge body, the engaging part is engaged with the bracket at a periphery of the second opening.

5. The printing fluid cartridge according to claim 4, wherein the restriction member includes a release part that is configured to open a sealing part that is configured to seal the air communicating part, the release part being configured to open the sealing part by moving in a direction toward the sealing part.

6. The printing fluid cartridge according to claim 4, wherein the engaging part includes a pair of hooks that are configured to be engaged with an inner periphery of the second opening, the pair of hooks being aligned in a direction intersecting the second direction.

7. A restriction member capable of being mounted in a printing fluid cartridge, the printing fluid cartridge including: a cartridge body having a printing fluid delivery unit provided on a first cartridge-body surface; and a bracket having at least a first bracket wall that confronts the first cartridge-body surface of the cartridge body, and a second bracket wall extending continuously from the first bracket wall in a first direction, the printing fluid delivery unit extending in the first direction, the bracket being capable of moving relative to the cartridge body in a second direction along which the second bracket wall contacts and separates from the cartridge body, the second direction intersecting the first direction, the restriction member being configured to be detachably mounted on the cartridge body and the bracket, the restriction member being configured to, when the restriction member is mounted on the cartridge body and the bracket, restrict relative movement between the cartridge body and the bracket in the second direction and maintain contact between the second bracket wall of the bracket and the cartridge body, wherein an electrical interface is provided on the second bracket wall of the bracket, and wherein the restriction member includes a hook configured to urge the cartridge body in a direction toward the electrical interface, thereby restricting relative movement between the cartridge body and the bracket in the second direction.

8. The restriction member according to claim 7, wherein the hook is configured to engage with the cartridge body, and wherein the restriction member further includes:

an engaging part configured to engage with the bracket, wherein the hook and the engaging part are configured so as to be engaged with the cartridge body and the bracket, respectively, while being aligned in the second direction.

* * * * *